US007570906B2

(12) United States Patent
Uehara

(10) Patent No.: US 7,570,906 B2
(45) Date of Patent: Aug. 4, 2009

(54) TANDEM TYPE COLOR IMAGE FORMING MACHINE

(75) Inventor: Masakazu Uehara, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 29 days.

(21) Appl. No.: 12/007,470

(22) Filed: Jan. 10, 2008

(65) Prior Publication Data

US 2008/0118292 A1 May 22, 2008

Related U.S. Application Data

(62) Division of application No. 11/184,807, filed on Jul. 20, 2005, now Pat. No. 7,343,124.

(30) Foreign Application Priority Data

Jul. 29, 2004 (JP) ..... 2004-221448

(51) Int. Cl.
*G03G 15/01* (2006.01)

(52) U.S. Cl. ..... 399/299; 399/303; 399/393; 399/400; 399/405

(58) Field of Classification Search ..... 399/16, 399/23, 107, 299, 393, 400, 405, 302, 303, 399/308, 388
See application file for complete search history.

(56) References Cited

U.S. PATENT DOCUMENTS

| | | | | |
|---|---|---|---|---|
| 5,701,573 | A * | 12/1997 | Yoshiuchi et al. | 399/400 |
| 6,122,468 | A * | 9/2000 | Sakamoto et al. | |
| 6,496,670 | B1 | 12/2002 | Ishikita et al. | |
| 6,798,430 | B2 | 9/2004 | Sato | |
| 2001/0055499 | A1 | 12/2001 | Sato | |
| 2004/0145645 | A1 * | 7/2004 | Gyoutoku et al. | |

FOREIGN PATENT DOCUMENTS

| | | |
|---|---|---|
| JP | 2000284639 | 10/2000 |
| JP | 2003-345101 | 3/2003 |
| JP | 2003-107838 | 9/2003 |

* cited by examiner

*Primary Examiner*—David M Gray
*Assistant Examiner*—Laura K Roth
(74) *Attorney, Agent, or Firm*—Smith, Gambrell & Russell, LLP

(57) ABSTRACT

A tandem type color image forming machine comprises a plurality of image forming units, a belt mechanism comprising an endless belt including a linear moving area, and a paper feed cassette in its image information machine body. The image forming units are arranged along the linear moving area of the belt with a space therebetween. The belt mechanism is arranged longitudinally so that the linear moving area of the belt extends almost in the vertical direction. The paper feed cassette is arranged longitudinally in the lateral direction of the belt mechanism or below the belt mechanism.

4 Claims, 12 Drawing Sheets

TANDEM TYPE COLOR IMAGE FORMING MACHINE

CROSS REFERENCE TO RELATED APPLICATION

This application is a division of Ser. No. 11/184,807, filed Jul. 20, 2005 now U.S. Pat. No. 7,343,124 and which is being incorporated in its entirety herein by reference.

FIELD OF THE INVENTION

The present invention relates to a tandem type color image forming machine such as an electrostatic copying machine, a laser printer or a facsimile.

Description of the Prior Art

In general, a tandem type color image forming machine comprises a plurality of image forming units for forming images with different color toners, a conveyor belt mechanism having a conveyor belt including a linear moving area for carrying paper, and a paper feed cassette for storing paper in its image forming machine body. The image forming units are arranged along the linear moving area of the conveyor belt with a space therebetween, and the conveyor belt mechanism comprises transfer units for transferring toner images formed by the image forming units to paper, corresponding to the image forming units (refer to JP-A 2003-107838) (the term "JP-A" as used herein means an "unexamined published Japanese patent application").

However, in this tandem type color image forming machine, as the conveyor belt mechanism is arranged sideways so that the linear moving area of the conveyor belt extends almost in the lateral direction and the paper feed cassette is arranged sideways below the conveyor belt mechanism, the width (size in the right-and-left direction when the image forming machine is seen from the front) of the image forming machine body becomes large, whereby the entire image forming machine body becomes bulky in the width direction.

Meanwhile, there is also known a tandem type color image forming machine in which a conveyor belt mechanism is arranged longitudinally so that the linear moving area of a conveyor belt extends almost in the vertical direction and image forming units are arranged along the linear moving area of the conveyor belt with a space therebetween (refer to JP-A2003-345101). However, as a paper feed cassette is arranged sideways in the lower end portion of the inside of the image forming machine body in this tandem type color image forming machine, the width of the image forming machine body becomes large. Particularly when large-sized paper is stored in the paper feed cassette, the paper feed cassette becomes large in size, whereby the entire image forming machine body becomes bulky in the width direction. The above problem is also existent in a tandem type color image forming machine in which image forming units are arranged along the linear moving area of a primary transfer belt (intermediate transfer belt) with a space therebetween.

SUMMARY OF THE INVENTION

It is an object of the present invention to provide a novel tandem type color image forming machine which enables the width of its image forming machine body to be made smaller than that of the prior art, thereby making it possible to make the entire image forming machine body more compact in the width direction than that of the prior art.

According to the present invention, the above object can be attained by a tandem type color image forming machine comprising a plurality of image forming units for forming images with different color toners, a belt mechanism comprising an endless belt including a linear moving area, and a paper feed cassette for storing paper in its image information machine body, the image forming units being arranged along the linear moving area of the belt with a space therebetween, wherein the belt mechanism is arranged longitudinally so that the linear moving area of the belt extends almost in the vertical direction, and the paper feed cassette is arranged longitudinally in the lateral direction of the belt mechanism or below the belt mechanism.

Preferably, a pair of discharge rollers are arranged in the upper end portion of the inside of the image forming machine body, and a pocket for receiving and storing paper discharged from the pair of discharge rollers and going downward by its own weight is formed on one side face of the image forming machine body in such a manner that it extends along the one side face in the vertical direction.

Preferably, the belt is a conveyor belt including the linear moving area for carrying paper, the belt mechanism is a conveyor belt mechanism comprising the conveyor belt, and the paper feed cassette is arranged in the lateral direction of the conveyor belt mechanism.

Preferably, the conveyor belt of the conveyor belt mechanism is arranged around a plurality of rollers, a charging conveyor roller is pressed against one of the rollers arranged in the lower end area of the conveyor belt on the upstream side of the linear moving area of the conveyor belt through the conveyor belt, and the position of the paper feed cassette relative to the conveyor belt mechanism is determined such that paper stored in the paper feed cassette is delivered downward toward a nip portion between the charging conveyor roller and the conveyor belt.

Preferably, a paper inversion conveyor passage for inverting paper fed downward from the paper feed cassette and carrying it upward toward the linear moving area of the conveyor belt is formed between the paper feed cassette and the conveyor belt mechanism.

Preferably, a fixing unit is arranged above the conveyor belt mechanism in the upper end portion of the inside of the image forming machine body, a paper conveyor passage for guiding paper which is carried by the conveyor belt mechanism and to which toner images have been transferred to the fixing unit is formed between the conveyor belt mechanism and the fixing unit, and the paper conveyor passage and the linear moving area of the conveyor belt are aligned with each other almost in the vertical direction.

Preferably, a pair of discharge rollers are arranged in the upper end portion of the inside of the image forming machine body, a paper discharge passage is formed between the fixing unit and the pair of discharge rollers in such a manner that it extends upward from the fixing unit, curves and goes toward the pair of discharge rollers almost in the lateral direction, and a pocket for receiving and storing paper discharged from the pair of discharge rollers and going downward by its own weight is formed on one side face of the image forming machine body in the downstream direction of the pair of discharge rollers in such a manner that it extends along the one side face in the vertical direction.

Preferably, the belt is a conveyor belt including the linear moving area for carrying paper, the belt mechanism is a conveyor belt mechanism comprising the conveyor belt, and the paper feed cassette is arranged below the conveyor belt mechanism.

Preferably, a paper feed conveyor passage for carrying paper fed upward from the paper feed cassette upward toward the linear moving area of the conveyor belt is formed between the paper feed cassette and the conveyor belt mechanism, a fixing unit is arranged above the conveyor belt mechanism in the upper end portion of the inside of the image forming machine body, a paper conveyor passage for guiding paper which is carried by the conveyor belt mechanism and to which toner images have been transferred to the fixing unit is formed between the conveyor belt mechanism and the fixing unit, and the paper conveyor passage, the linear moving area of the conveyor belt and the paper feed conveyor passage are aligned with one another almost in the vertical direction.

Preferably, a pair of discharge rollers are arranged in the upper end portion of the inside of the image forming machine body, a paper discharge passage is formed between the fixing unit and the pair of discharge rollers in such a manner that it extends upward from the fixing unit, curves and goes toward the pair of discharge rollers almost in the lateral direction, and a pocket for receiving and storing paper discharged from the pair of discharge rollers and going downward by its own weight is formed on one side face of the image forming machine body in the downstream direction of the pair of discharge rollers in such a manner that it extends along the one side face in the vertical direction.

Preferably, the belt is a primary transfer belt including the linear moving area to which toner images formed by the image forming units are transferred in such a manner that they are superimposed one upon another, the belt mechanism is a primary transfer belt mechanism comprising the primary transfer belt, and the paper feed cassette is arranged in the lateral direction of the primary transfer belt mechanism.

Preferably, a secondary transfer unit for transferring toner images transferred to the primary transfer belt to paper fed from the paper feed cassette is provided in the image forming machine body and opposed to the top portion of the primary transfer belt, a paper feed conveyor passage for guiding paper fed upward from the paper feed cassette between the primary transfer belt and the secondary transfer unit almost in the lateral direction is formed between the paper feed cassette and the primary transfer belt mechanism, and a fixing unit is arranged on the extension line in the downstream direction of the paper conveyor passage almost in the lateral direction of the top portion of the primary transfer belt mechanism in the upper end portion of the inside of the image forming machine body.

Preferably, a pair of discharge rollers are installed in the upper end portion of the inside of the image forming machine body, a paper discharge passage is formed between the fixing unit and the pair of discharge rollers in such a manner that it extends upward from the fixing unit, curves and goes toward the pair of discharge rollers almost in the lateral direction, and a pocket for receiving and storing paper discharged from the pair of discharge rollers and going downward by its own weight is formed on one side face of the image forming machine body in the downstream direction of the pair of discharge rollers in such a manner that it extends along the one side face in the vertical direction.

Preferably, a paper discharge tray for receiving paper discharged by the pair of discharge rollers is provided on the top surface of the image forming machine body.

Preferably, a secondary transfer unit for transferring toner images transferred to the primary transfer belt to paper fed from the paper feed cassette is provided in the image forming machine body and opposed to the bottom portion of the primary transfer belt, a paper feed conveyor passage for guiding paper fed downward from the paper feed cassette between the primary transfer belt and the secondary transfer unit almost in the lateral direction is formed between the paper feed cassette and the primary transfer belt mechanism, and a fixing unit is arranged on the extension line in the downstream direction of the paper feed conveyor passage almost in the lateral direction of the bottom portion of the primary transfer belt mechanism in the lower end portion of the inside of the image forming machine body.

Preferably, a pair of discharge rollers are installed in the upper end portion of the inside of the image forming machine body, a paper discharge passage is formed between the fixing unit and the pair of discharge rollers in such a manner that it extends upward from the fixing unit, curves and goes toward the pair of discharge rollers almost in the lateral direction, and a pocket for receiving and storing paper discharged from the pair of discharge rollers and going downward by its own weight is formed on one side face of the image forming machine body in the downstream direction of the pair of discharge rollers in such a manner that it extends along the one side face in the vertical direction.

Preferably, a paper discharge tray for receiving paper discharged by the pair of discharge rollers is provided on the top surface of the image forming machine body.

DETAILED DESCRIPTION OF THE PREFERRED EMBODIMENTS

Preferred embodiments of a tandem type color image forming machine constituted in accordance with the present invention will be described in more detail with reference with the accompanying drawings. The illustrated tandem type color image forming machine is a tandem type color LED printer. In FIGS. 1 to 13, substantially the same constituent elements are given the same reference symbols.

Figure 1:
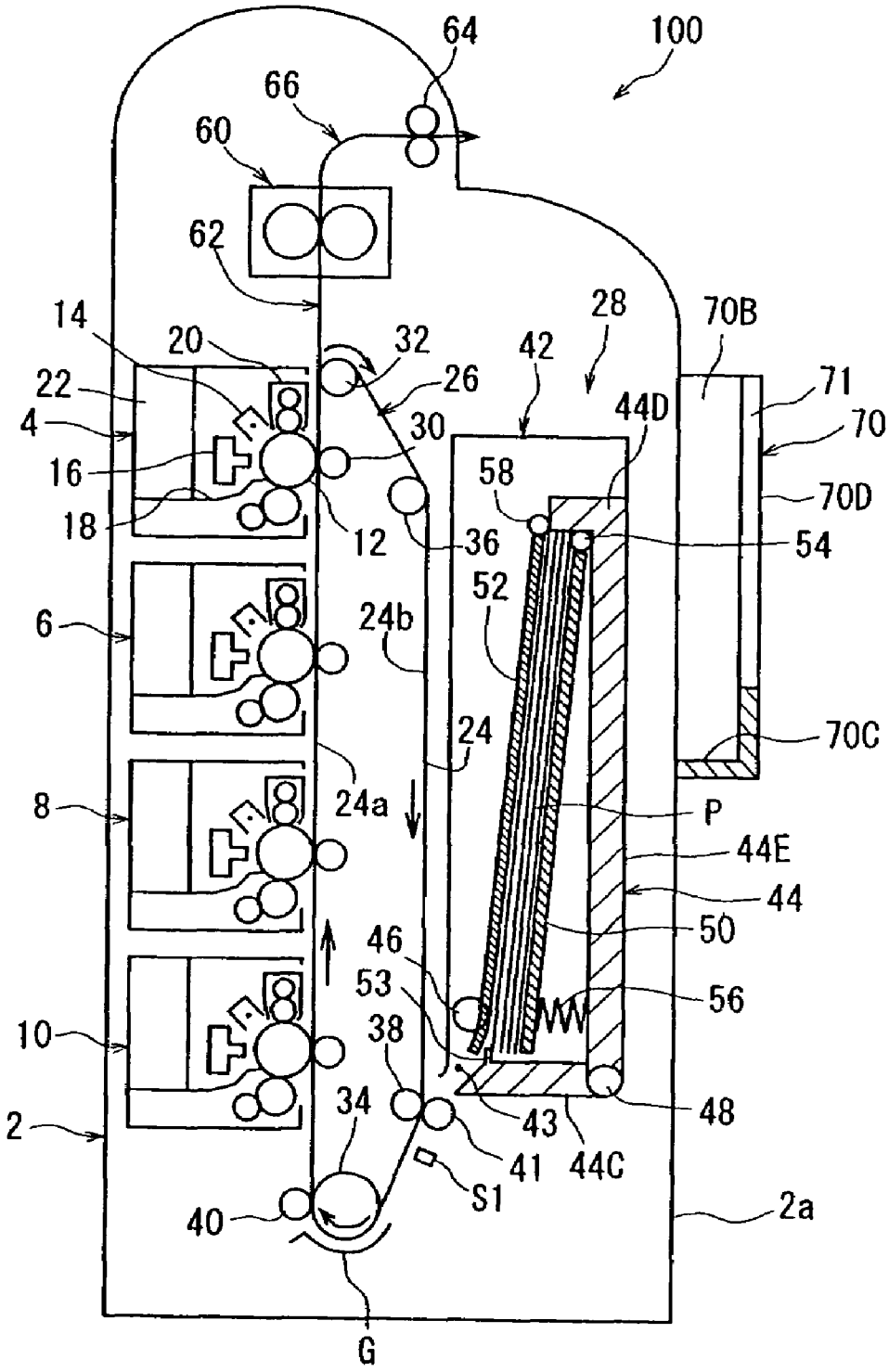
FIG. 1 is a schematic diagram showing an embodiment of a tandem type color image forming machine constituted according to the present invention.

With reference to FIG. 1, a tandem type color image forming machine (to be simply referred to as "image forming machine" hereinafter) 100 has an image-forming machine body 2 of nearly a rectangular parallelpiped shape. In this image forming machine body 2, a plurality of image forming units for forming images with different color toners, i.e., a black toner image forming unit 4, a cyan toner image forming unit 6, a magenta toner image forming unit 8 and a yellow toner image forming unit 10 in this embodiment are installed in this order from the top toward the bottom in FIG. 1. These image forming units 4, 6, 8 and 10 are each provided with image forming elements such as a photosensitive material drum 12, a charging unit 14, an LED head 16 which is part of exposure means, a developing unit 18 and a cleaning unit 20. The developing units 18 of the image forming units 4, 6, 8 and 10 are each equipped with a toner container 22 for supplying a respective color toner. For simplifying illustration in FIG. 1, reference numerals for the image forming elements are given only to the black toner image forming unit 4.

In the image forming machine body 2, there are further installed a belt mechanism comprising an endless belt including a linear moving area, i.e., a conveyor belt mechanism 26 comprising a conveyor belt 24 including a linear moving area 24*a* for carrying paper P in this embodiment, and a paper feed cassette 28 for storing the paper P. The image forming units 4, 6, 8 and 10 are arranged along the linear moving area 24*a* of the conveyor belt 24 with a space therebetween. The conveyor belt mechanism 26 comprises transfer units for transferring toner images formed by the image forming units 4, 6, 8 and 10 to the paper P, i.e., transfer rollers 30 in this embodiment, corresponding to the photosensitive material drums 12 of the image forming units 4, 6, 8 and 10. The linear moving area 24*a* of the conveyor belt 24 exists between the photosensitive material drums 12 and the respective transfer rollers 30. For simplifying illustration, the reference numeral 30 for these transfer rollers is given only to the transfer roller for the photosensitive material drum 12 of the black toner image forming unit 4.

The conveyor belt mechanism 26 is arranged longitudinally so that the linear moving area 24*a* of the conveyor belt 24 extends almost in the vertical direction. The conveyor belt 24 which is an endless belt is looped over a plurality of rollers, i.e., a drive roller 32 and follower rollers 34, 36 and 38 in this embodiment. The drive roller 32 driven in the clockwise direction in FIG. 1 by an unshown electric motor is disposed at the top of the conveyor belt mechanism 26, and the follower roller 34 is existent at the bottom of the conveyor belt mechanism 26 almost right below the drive roller 32 in the vertical direction. The follower roller 36 is off to the lower right of the drive roller 32 in FIG. 1 in the upper end area of the conveyor belt 24. The follower roller 38 is off to the upper right of the follower roller 34 in FIG. 1 in the lower end area of the conveyor belt 24. The follower roller 34 is in pressure contact with another follower roller 40 from the left direction in FIG. 1. The linear moving area 24*a* of the conveyor belt 24 is formed between the drive roller 32 and the follower roller 34. The other linear moving area 24*b* is formed between the follower roller 36 and the follower roller 38. The other linear moving area 24*b* extends substantially in parallel to the linear moving area 24*a* with a space therebetween in the lateral direction in FIG. 1. The image forming units 4, 6, 8 and 10 are arranged on the left side of the linear moving area 24*a* in FIG. 1. When the drive roller 32 is turned in the clockwise direction in FIG. 1, the conveyor belt 24 is turned in the same direction. The follower rollers 34, 36 and 38 are also turned in the same direction by the conveyor belt 24. The linear moving area 24*a* of the conveyor belt 24 is moved upward in FIG. 1.

A charging conveyor roller 41 is pressed against the follower roller 38 which is one of the rollers arranged in the lower end area of the conveyor belt 24 on the upstream side of the linear moving area 24*a* of the conveyor belt 24 through the conveyor belt 24. The charging conveyor roller 41 has the function of partially charging the conveyor belt 24 as negative or positive bias is applied to the charging conveyor roller 41 by unshown bias application means so that paper P fed from the paper feed cassette 28 is electrostatically adsorbed to and carried on the conveyor belt 24. The charging conveyor roller 41 follows the movement of the conveyor belt 24. Below the conveyor belt 24 wrapped around the lower end area of the outer wall of the follower roller 34 having a relatively large diameter, an arcuate guide plate G is installed with a space therebetween. The guide plate G is provided to guide the end of the paper P electrostatically adsorbed to and carried on the conveyor belt 24 to a nip portion between the follower roller 34 and the follower roller 40. A paper detection sensor S1 for detecting the end of the paper P adsorbed to and carried on the conveyor belt 24 is arranged at a position on the downstream side of the charging conveyor roller 41. The timing when the end of the paper P fed from the paper feed cassette 28 passes is detected by the paper detection sensor S1 to calculate the timing of outputting an image to the respective photosensitive material drum 12. The paper detection sensor S1 has a timing setting function in place of a pair of resist rollers.

The image forming units 4, 6, 8 and 10 are arranged on the left side of the image moving area 24*a* of the conveyor belt 24 with a space therebetween in the vertical direction in FIG. 1. The paper feed cassette 28 is arranged longitudinally so that the paper P is delivered downward and spaced apart from the conveyor belt mechanism 26 in the lateral direction (right side in the lateral direction of the conveyor belt mechanism 26 in FIG. 1).

With reference to FIGS. 1 to 5, the paper feed cassette 28 comprises a box-like cassette body 42 and a box-like cassette 44 movably stored in the cassette body 42. The cassette body 42 is rectangular with the shorter side at the top when seen from the front of the image forming machine body 2 (when the sheet is seen from the front in FIG. 1 and FIG. 4; when seen in the direction of an arrow A in FIG. 2, FIG. 3 and FIG. 5) and is supported such that it can be drawn from the front face 2A (FIG. 2) of the image forming machine body 2 over unshown slide rails. The slide rails may be, for example, the Accuride (registered trademark) ball bearing type slide rails. A rectangular opening 3 with the shorter side at the top is formed in the front face 2A of the image forming machine body 2 in conformity with the cassette body 42. The cassette body 42 has, when seen from the front, a front wall 42A and a rear wall 42B which are opposed to and parallel to each other with a space therebetween in the front-and-rear direction, a top wall 42C and a bottom wall 42D which are opposed to and parallel to each other with a space therebetween in the vertical direction, and one side wall 42E for covering one sides (left sides in FIG. 1) of the front wall 42A, rear wall 42B, top wall 42C and bottom wall 42D. The other side face (right side face in FIG. 1) of the cassette body 42 is open rectangular. In the corner portion where the bottom wall 42D and the one side wall 42E cross each other, an opening 43 (FIG. 4) for delivering paper is formed. In FIG. 1, the top wall 42C, bottom wall 42D and one side wall 42E are not shown for simplifying illustration (they are also not shown in FIGS. 6 to 9).

A paper feed roller 46 is disposed on the left side when seen from the front in the lower end portion of the inside of the cassette body 42. The paper feed roller 46 is fitted onto the center portion of a shaft 46A by an unshown one-way clutch, and the front end and the rear end of the shaft 46A are rotatably supported to the front wall 42A and the rear wall 42B, respectively. Not shown, the rear end of the shaft 46A projects backward from the rear wall 42B, and a driven coupling is fitted onto the projecting portion of the shaft 46A. When the paper feed cassette 28 is pushed into the inside of the image forming machine body 2 from the front face 2A toward the unshown rear face, the driven coupling is detachably connected to an unshown drive coupling provided in the image forming machine body 2 and driven by an unshown electric motor installed in the image forming machine body 2.

Figure 4:
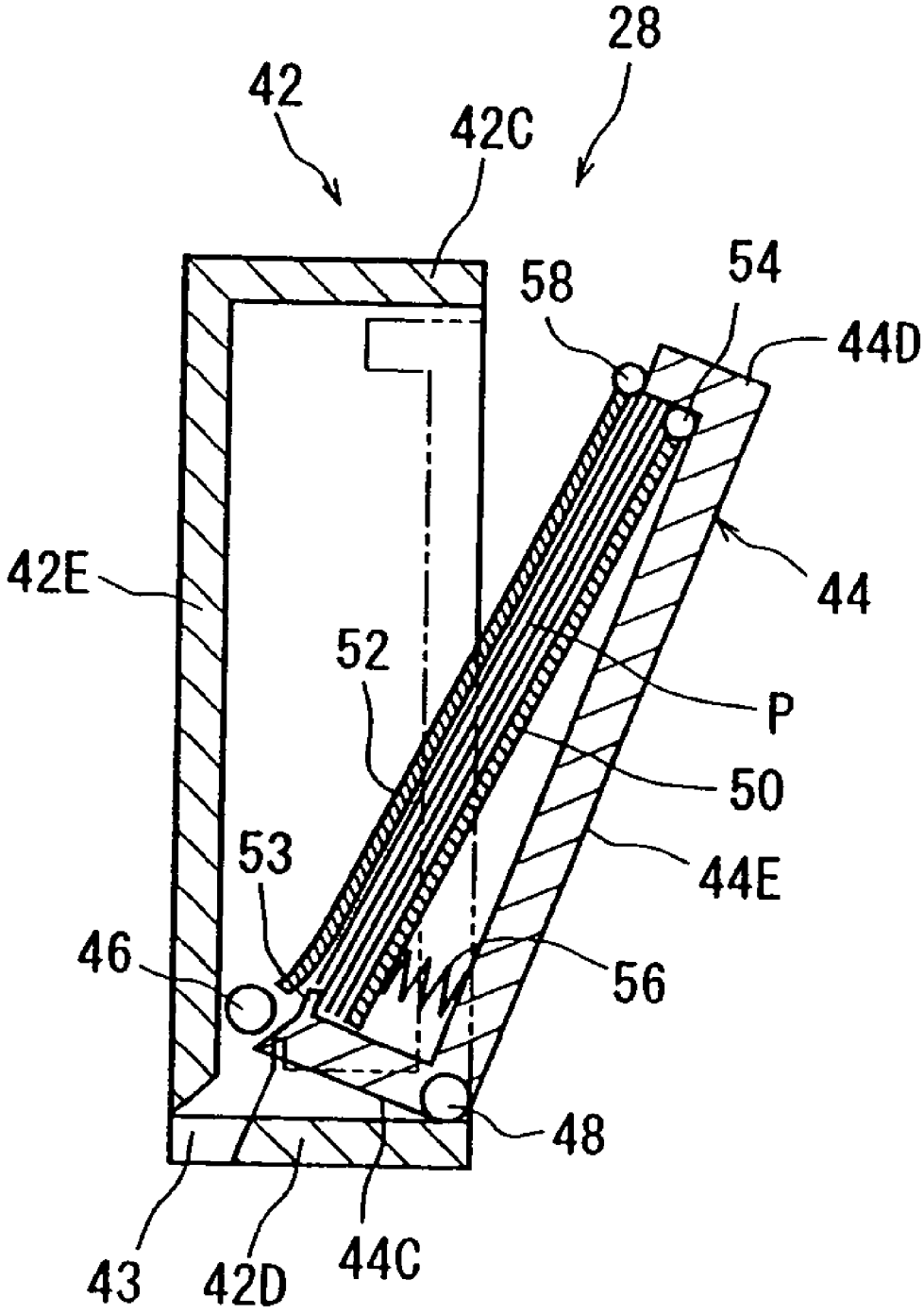
FIG. 4 is a sectional view of the paper feed cassette shown in FIG. 3.
Figure 5:
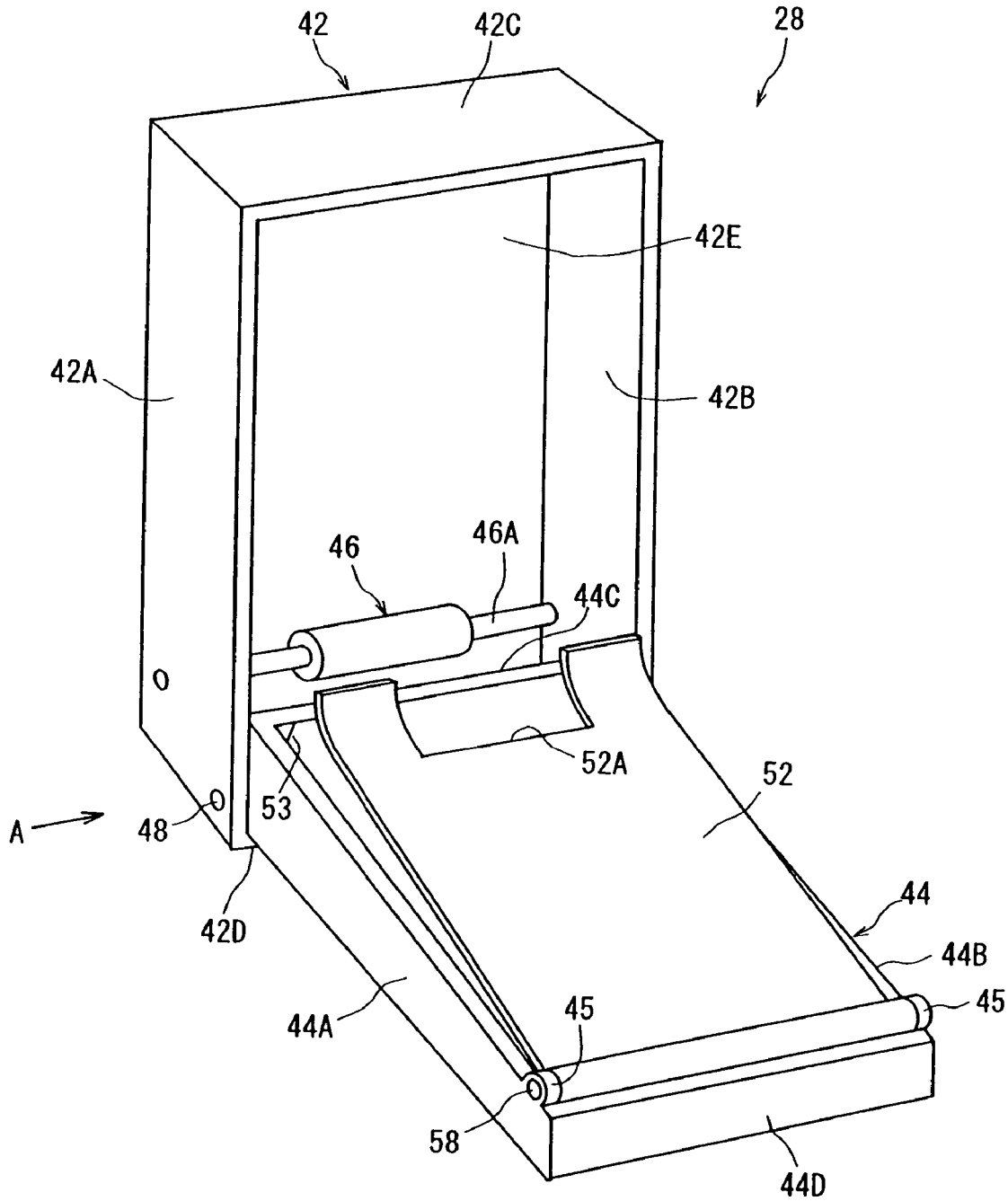
FIG. 5 is a perspective view schematically illustrating a state where the cassette is completely turned to the outside of the cassette body in the paper feed cassette shown in FIG. 1 and FIG. 2.

The cassette 44 has when seen from the front a front wall 44A and a rear wall 44B which are opposed to and parallel to each other with a space therebetween in the front-and-rear direction, one side wall 44C and the other side wall 44D which are opposed to and parallel to each other with a space therebetween in the direction perpendicular to the direction shown by the arrow A in FIG. 5, and a bottom wall 44E for covering the bottoms of the front wall 44A, the rear wall 434B, the one side wall 44C and the other side wall 44D. A rectangular opening is formed in the top face (in FIG. 5) of the cassette 44. A separation claw 53 (only one is shown in FIG. 1, FIG. 4 and FIG. 5) for the paper P is provided in the corner where the one side wall 44C and the front wall 44A cross each other and in the corner where the one side wall 44C and the rear wall 44B cross each other at the upper end in FIG. 5 of the cassette 44. The cassette 44 is supported such that it can turn round the shaft 48 between an acting position (position shown in FIG. 1) where it is stored in the cassette body 42 and a non-acting position (position shown in FIG. 5, FIG. 4 shows a halfway position) where it is opened to the outside of the cassette body 42. The shaft 48 projects forward and backward from corner areas where the front wall 44A and the rear wall 44B of the cassette 44 intersect with the one side wall 44C and the bottom wall 44E and is rotatably supported to unshown bearings formed in the front wall 42A and the rear wall 42B of the cassette body 42.

The cassette 44 is provided with a paper supporting plate 50 on which paper sheets P are stacked while it is open to the non-acting position and a paper fall preventing plate 52 for pressing the paper sheets P stacked on the paper supporting plate 50 against the paper supporting plate 50. The paper supporting plate 50 has a shaft 54 which projects from the upper end of the paper supporting plate 50 in the front-and-rear direction in FIG. 1 and FIG. 4 and is rotatably supported to unshown bearings formed in the front wall 44A and the rear wall 44B of the cassette 44 in the upper end corner portions (on the inner sides of corners where the other side wall 44D and the bottom wall 44E cross each other) of the inside of the cassette 44. Thus, the paper supporting plate 50 is supported such that it turns round the shaft 54 in the cassette 44. A compression coil spring 56 for urging the lower end portion of the paper supporting plate 50 against the paper feed roller 46 is interposed between the lower end portion (FIG. 1 and FIG. 4) of the paper supporting plate 50 and the corresponding lower end portion (lower end portion of the bottom wall 44E) of the cassette 44. One end (upper end in FIG. 1 and FIG. 4) of the paper fall preventing plate 52 is supported to bearings 45 (FIG. 5) provided at the upper end in FIG. 5 of corner areas where the front wall 44A and the rear wall 44B of the cassette 44 intersect with the other side wall 44D in such a manner that it can turn round a shaft 58. An unshown twisted coil spring for urging the paper fall preventing plate 52 in the counter-clockwise direction in FIG. 1 and FIG. 4 round the shaft 58 is fitted onto the shaft 58. A cut-out 52A for preventing interference with the paper feed roller 46 is formed in the center portion at the other end (center portion at the lower end in FIG. 1 and FIG. 4) of the paper fall preventing plate 52.

While the cassette 44 is opened to the non-acting position (FIG. 5) and the paper fall preventing plate 52 is opened (unshown), the paper sheets P are stacked on the paper supporting plate 50. The paper sheets P stacked on the paper supporting plate 50 are pressed against the paper supporting plate 50 by closing the paper fall preventing plate 52. In this state, the cassette 44 is turned round the shaft 48 from the non-acting position (FIG. 5) to the acting position (FIG. 1) and stored in the cassette body 42. A lock mechanism which can be freely unlocked and may have known constitution is provided between the cassette 44 and the cassette body 42. The lower end portion of the stacked paper P positioned at the left end in FIG. 1 is pressed against the paper feed roller 46. The paper feed cassette 28 is pushed into the image forming machine body 2 over the above-described slide rails and locked at a predetermined mounting position in such a manner that it can be freely unlocked. A lock mechanism which can be freely unlocked and may have known constitution is provided between the cassette body 42 and the image forming machine body 2. The paper feed cassette 28 is pushed into the mounting position in the image forming machine body 2 from the opening 3 (FIG. 2) and drawn forward from the front face 2A of the image forming machine body 2 from the mounting position. The position of the paper feed cassette 28 relative to the conveyor belt mechanism 26 is determined so that the paper P stored in the paper feed cassette 28 can be delivered downward toward the nip portion between the charging conveyor roller 41 and the conveyor belt 24 while the paper feed cassette 28 is set in the image forming machine body 2. As shown in FIG. 1, the opening 43 for paper feeding of the paper feed cassette 28 is positioned right on the upstream side of the nip portion.

Returning to FIG. 1, a fixing unit 60 is disposed above the conveyor belt mechanism 26 in the upper end portion of the inside of the image forming machine body 2. A paper conveyor passage 62 for guiding the paper P to which toner images have been transferred and which is carried by the conveyor belt mechanism 26 to the fixing unit 60 is formed between the conveyor belt mechanism 26 and the fixing unit 60. The paper conveyor passage 62 and the linear moving area 24*a* of the conveyor belt 24 are aligned with each other almost in the vertical direction.

A pair of discharge rollers 64 for discharging the paper P on which toner images have been fixed and which is carried from the fixing unit 60 from the image forming machine body 2 is arranged above the fixing unit 60 in the upper end portion of the inside of the image forming machine body 2. A paper discharge passage 66 for guiding the paper P on which toner images have been fixed by the fixing unit 60 and which is carried from the fixing unit 60 to the pair of discharge rollers 64 is formed between the fixing unit 60 and the pair of discharge rollers 64. The paper discharge passage 66 extends upward from the fixing apparatus 60, curves and then goes toward the pair of discharge rollers 64 almost in the lateral direction (right direction in FIG. 1).

Figure 2:
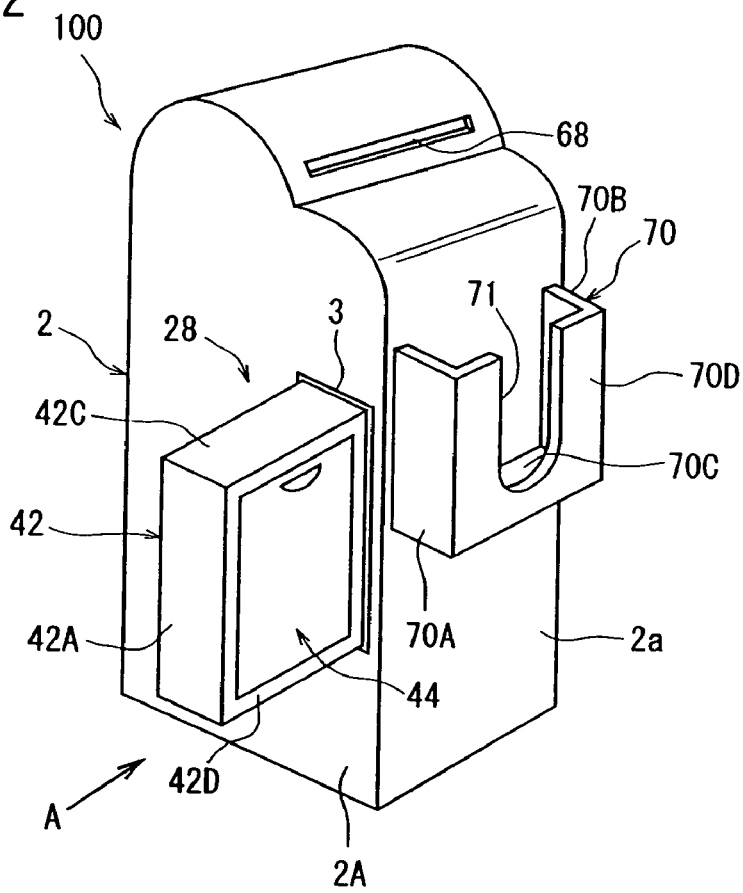
FIG. 2 is a perspective view schematically illustrating a state where a paper feed cassette is drawn forward from the image forming machine body of the image forming machine shown in FIG. 1.
Figure 3:
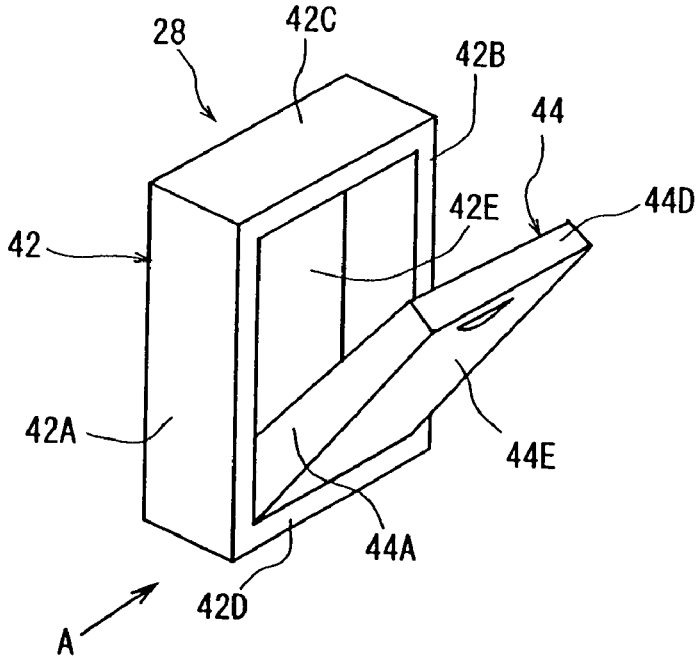
FIG. 3 is a perspective view schematically illustrating a state where a cassette is partially turned to the outside of the cassette body in the paper feed cassette shown in FIG. 1 and FIG. 2.

With reference to FIG. 1 and FIG. 2, a paper discharge port 68 is formed at a down stream position of the pair of discharge rollers 64 in the upper end portion of the image forming machine body 2. A pocket 70 for receiving and storing the paper P discharged from the pair of discharge rollers 64 almost in the lateral direction and going downward by its own weight is formed on one side face 2*a* of the image forming machine body 2 in the downstream direction (right direction in FIG. 1) beyond the pair of discharge rollers of the paper discharge passage 66 in such a manner that it extends along the one side face 2*a* in the vertical direction. The one side face 2*a* is formed almost vertically. The pocket 70 has a front wall 70A, a rear wall 70B and a bottom wall 70C all of which project outward from the one side face 2*a* of the image forming machine body 2*a* predetermined length, and an end wall 70D for covering the ends of the front wall 70A, the rear wall 70B and the bottom wall 70C. The front wall 70A and the rear wall 70B extend vertically in parallel to each other with a space therebetween in the front-and-rear direction and are rectangular with the shorter side at the top when seen from the front. The bottom wall 70C for covering the lower ends of the front wall 70A and the rear wall 70B has a flat rectangular shape. A cut-out 71 extending downward from the upper end with a predetermined width in the front-and-rear direction is formed in the center portion in the front-and-rear direction of the end wall 70D. A box-like paper receiving portion whose upper end is open rectangular is formed between the pocket 70 and the one side face 2*a* of the image forming machine body 2. It is preferred that the paper receiving position of the pocket 70 should be selected according to the size of paper P.

In the thus constituted image forming machine 100, when the paper feed roller 46 of the paper feed cassette 28 is driven, only one sheet of the paper P stored in the paper feed cassette 28 is fed by the separation function of the separation claws 53. When the end of the paper P reaches the nip portion between the charging conveyor roller 41 and the conveyor belt 24 to be nipped, the rotation of the paper feed roller 46 is stopped. The paper P is carried toward the linear moving area 24*a* while it is adsorbed to the conveyor belt 24 by cooperation between the charging conveyor roller 41 and the conveyor belt 24. The paper feed roller 46 follows the movement of the paper P fed by the function of the above-described one-way clutch (idled round the shaft 46A (FIG. 5)). Thus, the paper P carried by the conveyor belt mechanism 26 is conveyed between the photosensitive material drums 12 and the transfer rollers 30 of the image forming units 10, 8, 6 and 4 by the linear moving area 24*a* of the conveyor belt 24. In the image forming units 10, 8, 6 and 4, the surfaces of the photosensitive material drums 12 charged uniformly by the charging units 14 are exposed by the LED heads 16 to form electrostatic latent images which are then developed by the developing units 18 to become toner images. The toner images are transferred to the paper P carried over the linear moving area 24*a* of the conveyor belt 24 by the transfer rollers 30 sequentially from the toner image formed by the image forming unit 10 on the upstream side in such a manner that they are superimposed one upon another. The color toner images transferred to the paper P are fixed on the paper P while they pass through the fixing unit 60. The paper P on which the toner images have been fixed is discharged into the pocket 70 by the pair of discharge rollers 64 and stored. The toner not transferred and remaining on the surfaces of the photosensitive material drums 12 is removed by the cleaning units 20.

In the image forming machine 100 of the present invention, the belt mechanism, i.e., the conveyor belt mechanism 26 in this embodiment is arranged longitudinally so that the linear moving area 24*a* of the conveyor belt 24 extends almost in the vertical direction, and the paper feed cassette 28 is arranged longitudinally and spaced apart from the conveyor belt mechanism 26 in the lateral direction. Therefore, the width (right-and-left direction in FIG. 1) of the image forming machine body 2 can be made smaller than that of the prior art, thereby making it possible to make the entire image forming machine body 2 more compact in the width direction than in the prior art. Accordingly, the image forming machine 100 of the present invention is particularly advantageous for use at an office in which the installation space in the lateral direction is limited.

In the image forming machine 100 of the present invention, as the position of the paper feed cassette 28 relative to the conveyor belt mechanism 26 is determined so that the paper P stored in the paper feed cassette 28 can be delivered downward toward the nip portion between the charging conveyor roller 41 and the conveyor belt 24, a paper feed conveyor passage from the paper feed cassette 28 to the conveyor belt mechanism 26 can be omitted. As a result, the entire image forming machine body 2 can be made more compact in the width direction and the longitudinal direction (vertical direction) than in the prior art.

In the image forming machine 100 of the present invention, the paper conveyor passage 62 and the linear moving area 24*a* of the conveyor belt 24 are aligned with each other almost in the vertical direction. This constitution contributes to the reduction of the size in the width direction of the image forming machine body 2 and can suppress the occurrence of a jam because there is no curve in the conveyor passage of the paper P between the linear moving area 24*a* of the conveyor belt 24 and the fixing unit 60.

In the image forming machine 100 of the present invention, the pair of discharge rollers 64 are provided in the upper end portion of the inside of the image forming machine body 2. The paper discharge passage 66 is formed between the fixing unit 60 and the pair of discharge rollers 64. The paper discharge passage 66 extends upward from the fixing unit 60, curves and then goes toward the pair of discharge rollers 64 almost in the lateral direction. The pocket 70 for receiving and storing the paper P discharged almost in the lateral direction by the pair of discharge rollers 64 and going downward by its own weight is formed on one side face 2*a* of the image forming machine body 2 in the downstream direction of the pair of discharge rollers 64, that is, at a downstream position beyond the pair of discharge rollers 64 in the paper discharge passage 66 in such a manner that it extends along the one side face 2*a* in the vertical direction. This constitution contributes to the reduction of the size in the width direction of the image forming machine body 2, and the ends of the paper sheets P discharged from the paper discharge port 68 (FIG. 2) of the image forming machine body 2 are aligned in the pocket 70. In the illustrated embodiment, as the paper P is discharged into the pocket 70 in such a manner that its image formed surface faces up, the result of image forming operation can be checked while a plurality of paper sheets P are stored in the pocket 70.

Figure 6:
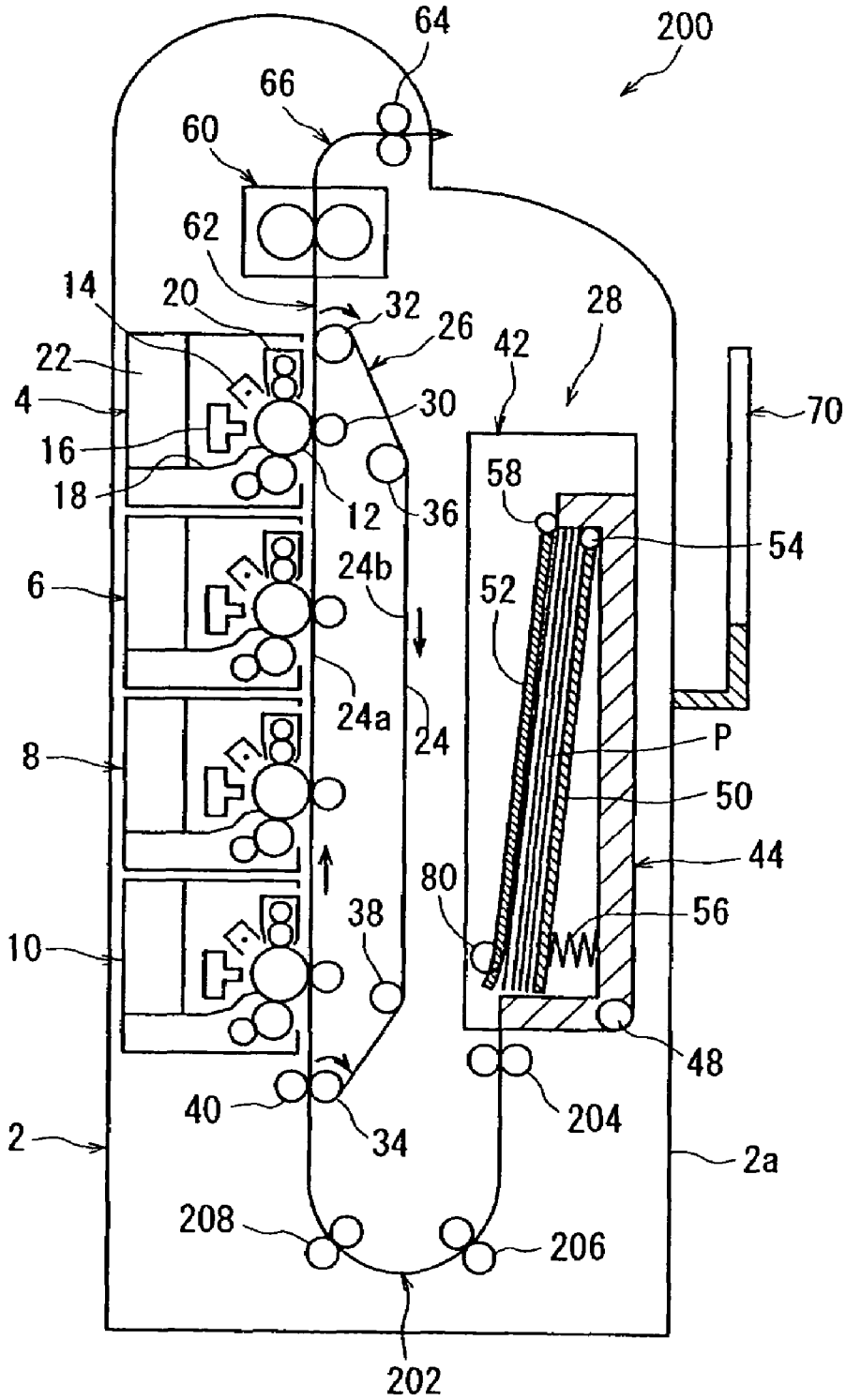
FIG. 6 is a schematic diagram showing another embodiment of a tandem type color image forming machine constituted according to the present invention.

FIG. 6 shows another embodiment of the image forming machine of the present invention. In the conveyor belt mechanism 26 of the image forming machine 200 shown in FIG. 6, the linear moving area 24*a* of the conveyor belt 24 is arranged longitudinally to extend almost vertically, and the image forming units 4, 6, 8 and 10 are arranged along the linear moving area 24*a* of the conveyor belt 24 with a space therebetween in the vertical direction in this order from the top toward the bottom. This basic constitution is substantially the same as that of the image forming machine 100 shown in FIG. 1. However, it differs from the image forming machine 100 shown in FIG. 1 in that the paper P is fed from the paper feed cassette 28 by a pick-up roller 80 and carried to the conveyor belt mechanism 26 along a paper inversion conveyor passage 202.

Stated more specifically, the paper P stored in the paper feed cassette 28 is delivered to the paper inversion conveyor passage 202 by the pick-up roller 80 provided in the paper feed cassette 28. The pick-up roller 80 which may have known constitution is installed substantially at the same position as the paper feed roller 46 in the above embodiment in the cassette body 42. As a matter of course, the one-way clutch in the above embodiment is not provided between the pick-up roller 80 and the unshown shaft. In the image forming machine body 2 of the image forming machine 200, the paper inversion conveyor passage 202 for inverting the paper P fed downward from the paper feed cassette 28 by the pick-up roller 80 and guiding it upward toward the conveyor belt mechanism 26 is formed between the paper feed cassette 28 and the conveyor belt mechanism 26. The paper inversion conveyor passage 202 is provided with a pair of paper separation rollers 204, a pair of conveyor rollers 206 and a pair of resist rollers 208 in this order from the upstream to the downstream. The cassette 44 of the paper feed cassette 28 is not provided with the separation claws 53 (FIG. 5). Other constitution is substantially the same as that of the image forming machine 100 shown in FIG. 1 and its description is omitted.

The size in the vertical direction of the entire image forming machine body 2 of the image forming machine 200 shown in FIG. 6 becomes larger than that of the image forming machine 100 by the installation space of the paper inversion conveyor passage 202. However, as this image forming machine 200 has substantially the same feature as the image forming machine 100 excluding this, substantially the same effect as that of the image forming machine 100 can be obtained. In the image forming machine 200 shown in FIG. 6, the paper feed cassette 28 is spaced apart from the conveyor belt mechanism 26 in the lateral direction in FIG. 6. It may be spaced apart from the conveyor belt mechanism 26 in the lateral direction in FIG. 6 with the image forming units 4, 6, 8 and 10 interposed between it and the conveyor belt mechanism 26.

Figure 7:
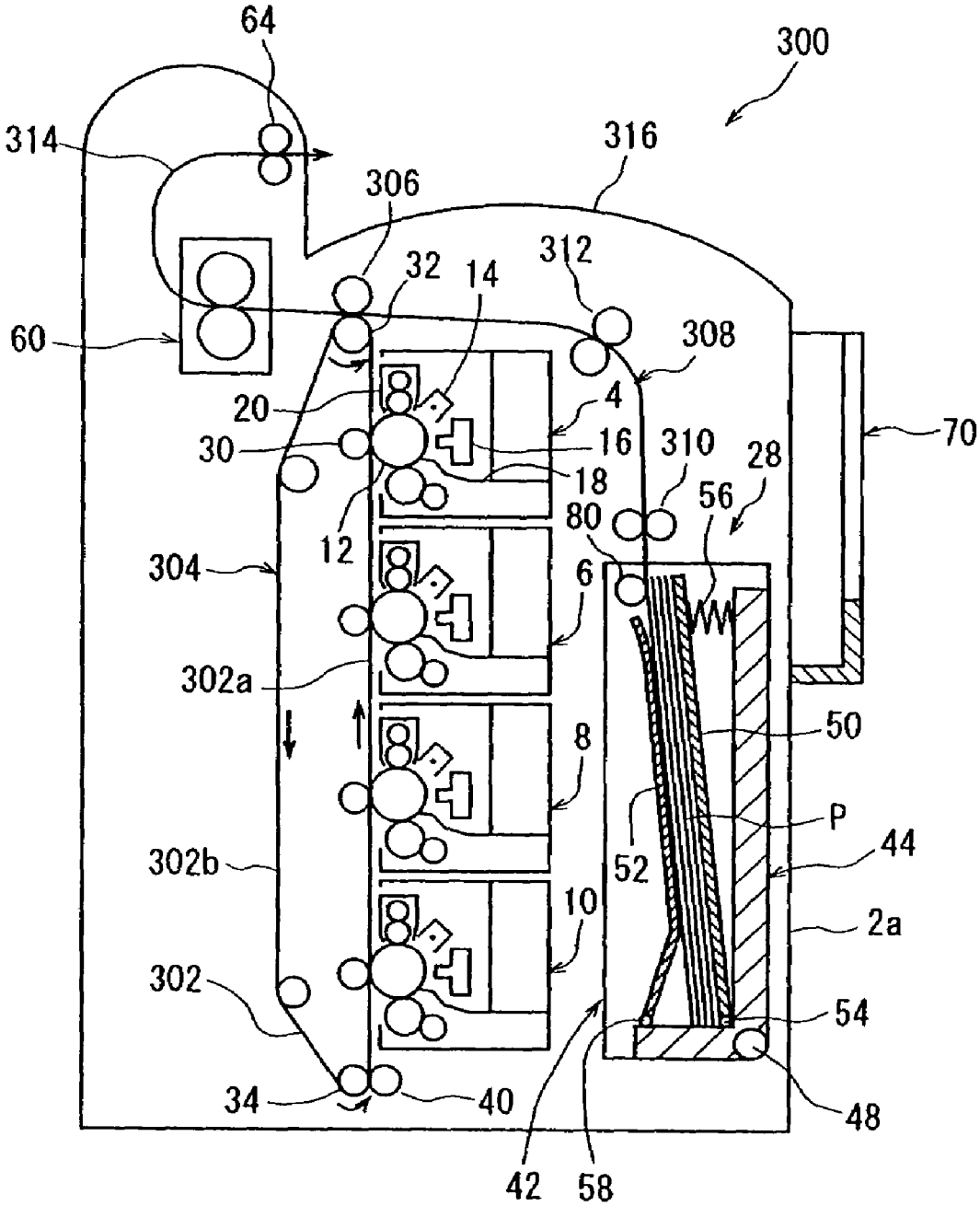
FIG. 7 is a schematic diagram showing still another embodiment of a tandem type color image forming machine constituted according to the present invention.

FIG. 7 shows still another embodiment of the image forming machine of the present invention. In the image forming machine body 2 of the image forming machine 300 shown in FIG. 7, the image forming units 4, 6, 8 and 10 are arranged in this order from the top toward the bottom in FIG. 7 like the image forming machines 100 and 200. In the image forming machine body 2, there are further installed a primary transfer belt mechanism 304 comprising a primary transfer belt 302 including a linear moving area 302*a* to which toner images formed by the image forming units 10, 8, 6 and 4 are transferred sequentially in such a manner that they are superimposed one upon another, the paper feed cassette 28 for storing the paper P and a secondary transfer roller 306 which is a secondary transfer unit for transferring toner images transferred to the primary transfer belt 302 to the paper P fed from the paper feed cassette 28. The image forming units 4, 6, 8 and 10 are arranged along the linear moving area 302*a* of the primary transfer belt 302 of the primary transfer belt mechanism 304 in this order from the top toward the bottom with a space therebetween in the vertical direction.

The primary transfer belt mechanism 304 is arranged longitudinally so that the linear moving area 302*a* of the primary transfer belt 302 extends almost in the vertical direction. The other linear moving area 302*b* of the primary transfer belt 302 extends parallel to the linear moving area 302*a* with a space therebetween on the left side in FIG. 7. The drive roller 32 positioned at the top of the primary transfer belt 302 is turned in the counterclockwise direction in FIG. 7. When the drive roller 32 is turned, the linear moving area 302*a* of the primary transfer belt 302 is moved upward. The image forming units 4, 6, 8 and 10 are arranged on the right side in FIG. 7 of the linear moving area 302*a*. The paper feed cassette 28 is arranged longitudinally and spaced apart from the primary transfer belt mechanism 304 in the lateral direction (on the right side in FIG. 7 with the image forming units 6, 8 and 10 interposed between it and the primary transfer belt mechanism 304). In the paper feed cassette 28, the pick-up roller 80 which is disposed in the upper end portion of the inside of the cassette body 42, the paper supporting plate 50, the paper fall preventing plate 52 and the compression coil spring 56 have been inverted from their positions in the paper feed cassette 28 of the image forming machine 200 with respect to the cassette 44 (the support mechanism for the cassette 44 is basically the same). The secondary transfer roller 306 is opposed to the top portion of the primary transfer belt 302 (top portion wrapped around the drive roller 32).

A paper feed conveyor passage 308 for guiding the paper P fed upward from the paper feed cassette 28 to the top portion of the primary transfer belt mechanism 304 almost in the lateral direction is formed between the paper feed cassette 28 and the primary transfer belt mechanism 304. In the paper feed conveyor passage 308, a pair of separated paper feed rollers 310 and a pair of resist rollers 312 are installed in this order from the upstream to the downstream. The fixing unit 60 is arranged on the extension line in the downstream direction of the paper feed conveyor passage 308 almost in the lateral direction of the top portion of the primary transfer belt mechanism 304 in the upper end portion of the inside of the image forming machine body 2. The pair of discharge rollers 64 are disposed above the fixing unit 60, and a paper inversion discharge passage 314 for inverting the paper P which is carried from the fixing unit 60 and on which toner images have been fixed by the fixing unit 60 and guiding it to the pair of discharge rollers 64 is formed between the fixing unit 60 and the pair of discharge rollers 64. A paper discharge tray 316 for receiving the paper P discharged from the pair of discharge rollers 64 almost in the lateral direction is provided on the top face of the image forming machine body 2. The pocket 70 is formed on one side face 2*a* of the image forming machine body 2 in the downstream direction (right direction in FIG. 7) of the paper discharge tray 316 in such a manner that it extends along the one side face 2*a* in the vertical direction.

In the thus constituted image forming machine 300, the surfaces of the photosensitive material drums 12 charged uniformly by the charging units 14 of the image forming units 10, 8, 6 and 4 are exposed by the LED heads 16 to form electrostatic latent images which are then developed by the developing units 18 to become toner images. The toner images are transferred to the surface of the linear moving area 302*a* of the primary transfer belt 302 of the primary transfer belt mechanism 304 sequentially from the toner image formed by the image forming unit 10 on the upstream side in such a manner that they are superimposed one upon another. The toner images transferred to the surface of the linear moving area 302*a* of the primary transfer belt 302 are transferred to the surface of the paper P fed from the paper feed cassette 28 along the paper feed conveyor passage 308 by the secondary transfer roller 306 at the top of the primary transfer belt 302. The color toner images transferred to the paper P are fixed on the paper P while they pass through the fixing unit 60. The paper P on which the color toner images have been fixed is discharged onto the paper discharge tray 316 or into the pocket 70 by the pair of discharge rollers 64. The paper P having a relatively small size is discharged onto the paper exhaust tray 316 and the paper P having a relatively large size is discharged into the pocket 70. The toner not transferred and remaining on the surfaces of the photo sensitive material drums 12 is removed by the cleaning units 20. The toner not transferred and remaining on the surface of the primary transfer belt 302 is removed by an unshown other cleaning unit.

In the image forming machine 300 shown in FIG. 7, the primary transfer belt mechanism 304 which is a belt mechanism is arranged longitudinally so that the linear moving area 302*a* of the primary transfer belt 302 which is a belt extends almost in the vertical direction, and the paper feed cassette 28 is arranged longitudinally and spaced apart from the primary transfer belt mechanism 304 in the lateral direction. Therefore, the width of the image forming machine body 2 (size in the right-and-left direction in FIG. 7) can be made smaller than that of the prior art, thereby making it possible to make the entire image forming machine body 2 more compact in the width direction than in the prior art. Accordingly, the image forming machine 300 of the present invention is particularly advantageous for use at an office in which the installation space in the lateral direction is limited.

In the image forming machine 300 shown in FIG. 7, the secondary transfer unit for transferring toner images transferred to the primary transfer belt 302 to the paper P fed from the paper feed cassette 28, i.e., the secondary transfer roller 306 in this embodiment is provided in the image forming machine body 2. The secondary transfer roller 306 is opposed to the top portion of the primary transfer belt 302, and the paper feed conveyor passage 308 for guiding the paper P fed upward from the paper feed cassette 28 between the primary transfer belt 302 and the secondary transfer roller 306 almost in the lateral direction is formed between the paper feed cassette 28 and the primary transfer belt mechanism 304. The fixing unit 60 is arranged on the extension line in the downstream direction of the paper feed conveyor passage 308 almost in the lateral direction of the top portion of the primary transfer belt mechanism 304 in the upper end portion of the inside of the image forming machine body 2. As a result, the entire image forming machine body 2 can be made more compact in the width direction and the longitudinal direction (vertical direction) than in the prior art.

In the image forming machine 300 shown in FIG. 7, the paper feed cassette 28 is arranged on the right side of the image forming units 6, 8 and 10 in FIG. 7 but may be arranged on the left side in the image forming machine body 2. In this case, the paper feed cassette 28, the image forming units 4, 6, 8 and 10 and the primary transfer belt mechanism 304 are inverted round a virtual vertical axis from their positions shown in FIG. 7. The pair of discharge rollers 64 are disposed in the right direction of the fixing unit 60, and the paper discharge tray 316 is omitted. The paper P discharged from the pair of discharge rollers 64 is discharged into the pocket 70 directly.

Figure 8:
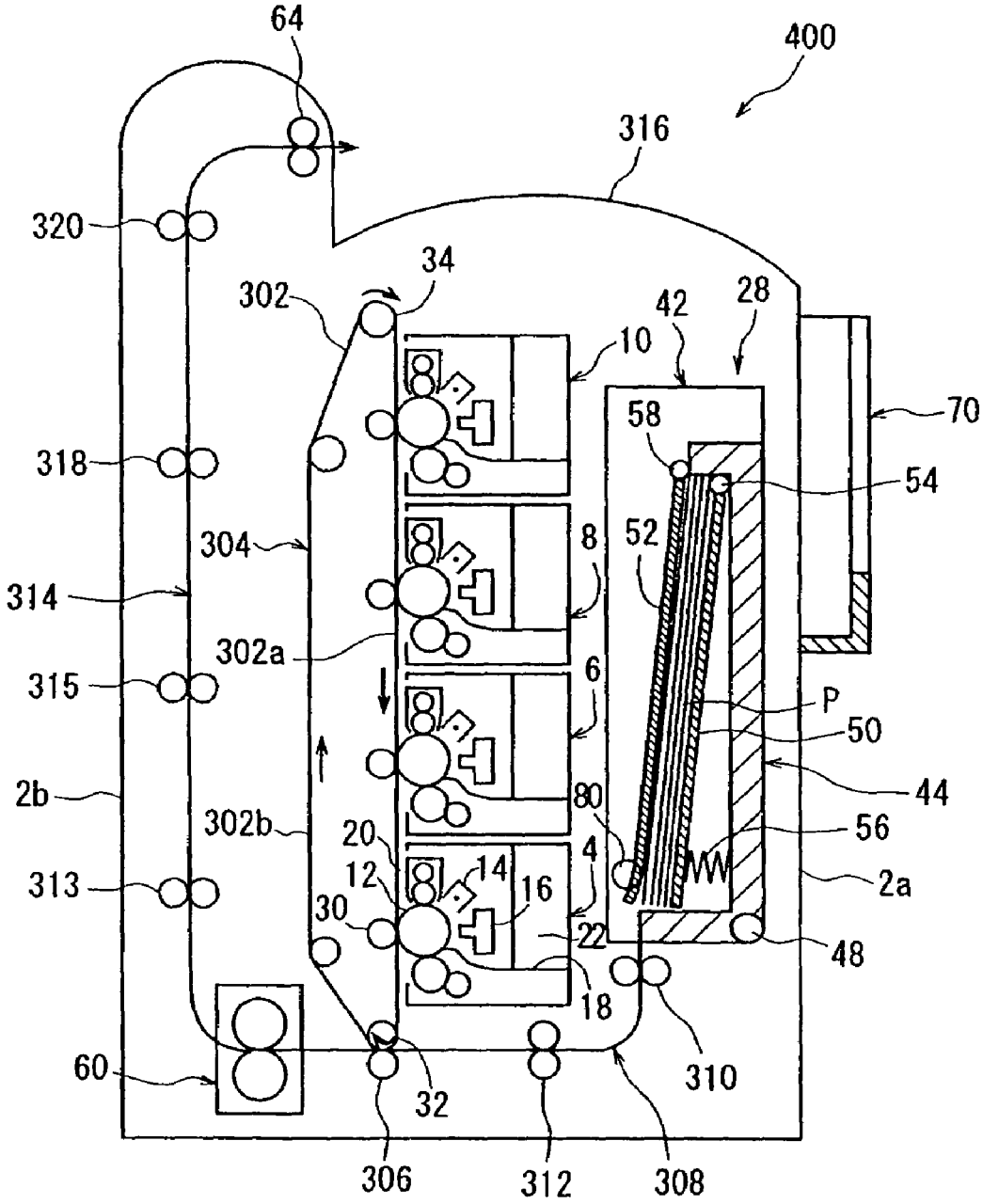
FIG. 8 is a schematic diagram showing a further embodiment of a tandem type color image forming machine constituted according to the present invention.

FIG. 8 shows a further embodiment of the image forming machine of the present invention. The image forming machine 400 shown in FIG. 8 is a modification of the image forming machine 300 shown in FIG. 7. In the image forming machine 400 shown in FIG. 8, the primary transfer belt mechanism 304 and the image forming units 4 to 10 have been inverted from the positions of the primary transfer belt mechanism 304 and the image forming units 4 to 10 in the image forming machine 300 shown in FIG. 7 in the vertical direction. That is, the drive roller 32 of the primary transfer belt mechanism 304 is positioned at the bottom of the primary transfer belt 302, and the follower roller 34 is positioned at the top of the primary transfer belt 302. The image forming units 4, 6, 8 and 10 are arranged along the linear moving area 302*a* of the primary transfer belt 302 in this order from the bottom toward the top with a space therebetween in the vertical direction.

The primary transfer belt mechanism 304 is arranged longitudinally so that the linear moving area 302*a* of the primary transfer belt 302 extends almost in the vertical direction. The other linear moving area 302*b* of the primary transfer belt 302 is arranged parallel to the linear moving area 302*a* with a space therebetween on the left side in FIG. 8. The drive roller 32 is turned in the clockwise direction in FIG. 8. When the drive roller 32 is turned, the linear moving area 302*a* of the primary transfer belt 302 is moved downward. The image forming units 4, 6, 8 and 10 are arranged on the right side in FIG. 8 of the linear moving area 302*a*. The paper feed cassette 28 is arranged longitudinally and spaced apart from the primary transfer belt mechanism 304 in the lateral direction (arranged on the right side of the primary transfer belt mechanism 304 with the image forming units 4, 6, 8 and 10 interposed therebetween in FIG. 8). The constitution and arrangement of the paper feed cassette 28 are substantially the same as those of the image forming machine 200 shown in FIG. 6.

The secondary transfer roller 306 is opposed to the bottom portion (bottom portion wrapped around the drive roller 32) of the primary transfer belt 302. The paper feed conveyor passage 308 for guiding the paper P fed downward from the paper feed cassette 28 toward the bottom portion of the primary transfer belt mechanism 304 almost in the lateral direction is formed between the paper feed cassette 28 and the primary transfer belt mechanism 304. In the paper feed conveyor passage 308, the pair of separated paper feed rollers 310 and the pair of resist rollers 312 are installed in this order from the upstream to the downstream. The fixing unit 60 is arranged on the extension line in the downstream direction of the paper feed conveyor passage 308 almost in the lateral direction of the top portion of the primary transfer belt mechanism 304 in the lower end portion of the inside of the image forming machine body 2. The pair of discharge rollers 64 are disposed above the fixing unit 60 in the upper end portion of the inside of the image forming machine body 2, and the paper inversion discharge passage 314 for inverting the paper P which is carried from the fixing unit 60 and on which toner images have been fixed by the fixing unit 60 and guiding it to the pair of discharge rollers 64 is formed between the fixing unit 60 and the pair of discharge rollers 64. An intermediate portion of the paper inversion discharge passage 314 extends almost vertically along the inner wall of the other side face 2*b* of the image forming machine body 2 (the other side face 2*b* opposite to the one side face 2*a* in the lateral direction in FIG. 8). The intermediate portion of the paper inversion discharge channel 314 is provided with pairs of paper conveyor rollers 313, 315, 318 and 320 with a space therebetween. The other constitution of the image forming machine 400 is substantially the same as that of the image forming machine 300 shown in FIG. 7 and its description is omitted.

In the thus constituted image forming machine 400, the surfaces of the photosensitive material drums 12 charged uniformly by the charging units 14 of the image forming units 10, 8, 6 and 4 are exposed by the LED heads 16 to form electrostatic latent images which are then developed by the developing units 18 to become toner images. The toner images are transferred to the surface of the linear moving area 302*a* of the primary transfer belt 302 of the primary transfer belt mechanism 304 sequentially from the toner image formed by the image forming unit 10 on the upstream side in such a manner that they are superimposed one upon another. The toner images transferred to the surface of the linear moving area 302*a* of the primary transfer belt 302 are transferred to the surface of the paper P fed from the paper feed cassette 28 along the paper feed conveyor passage 308 by the secondary transfer roller 306 at the bottom of the primary transfer belt 302. The color toner images transferred to the paper P are fixed on the paper P while they pass through the fixing unit 60. The paper P on which the color toner images have been fixed is carried to the pair of discharge rollers 64 along the paper inversion discharge passage 314 and discharged onto the paper discharge tray 316 or into the pocket 70 by the pair of discharge rollers 64. In the image forming machine 400 shown in FIG. 8, the primary transfer belt mechanism 304 which is a belt mechanism is arranged longitudinally so that the linear moving area 302*a* of the primary transfer belt 302 which is a belt extends almost in the vertical direction, and the paper feed cassette 28 is arranged longitudinally and spaced apart from the primary transfer belt mechanism 303 in the lateral direction. Therefore, the width of the image forming machine body 2 (size in the right-and-left direction in FIG. 8) can be made smaller than that of the prior art, there by making it possible to make the entire image forming machine body 2 more compact in the width direction than in the prior art. Accordingly, the image forming machine 400 of the present invention is particularly advantageous for use at an office in which the installation space in the lateral direction is limited.

Not shown, a copying machine having a small width can be realized by placing a scanner unit at the top of the image forming machine 300 or 400 shown in FIG. 7 or 8 in such a manner that it extends in the front-and-rear direction (direction perpendicular to the face of the sheet in FIG. 7 or FIG. 8). Since this scanner unit is positioned above the paper discharge tray 316 with a space therebetween, the paper discharge tray 316 can be used in the state shown in FIG. 7 or FIG. 8. Therefore, this copying machine is an in-barrel paper discharge type copying machine.

Figure 9:
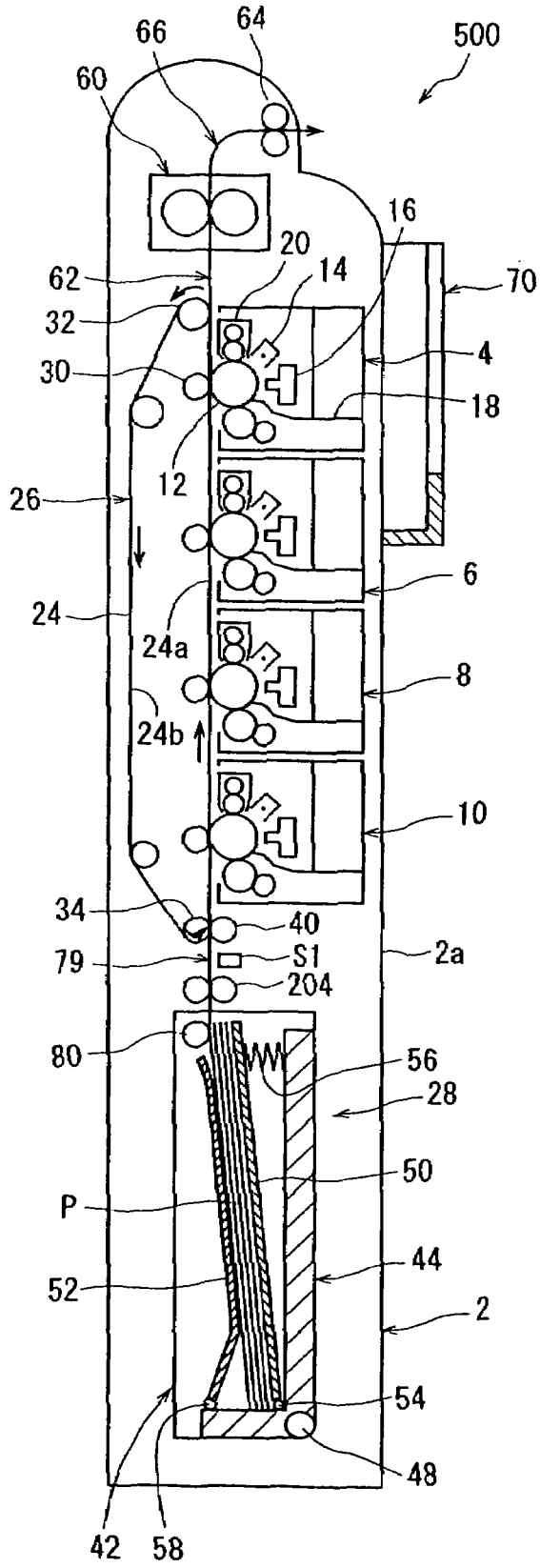
FIG. 9 is a schematic diagram showing a still further embodiment of a tandem type color image forming machine constituted according to the present invention.

FIG. 9 shows a still further embodiment of the image forming machine of the present invention. In the image forming machine 500 shown in FIG. 9, the linear moving area 24*a* of the conveyor belt 24 of the conveyor belt mechanism 26 extends almost vertically, and the image forming units 4, 6, 8 and 10 are arranged along the linear moving area 24*a* of the conveyor belt 24 in this order from the top toward the bottom with a space therebetween in the vertical direction. Although this basic constitution is substantially the same as that of the image forming machine 200 shown in FIG. 6, the image forming machine 500 greatly differs from the image forming machine 200 shown in FIG. 6 in that the paper feed cassette 28 is arranged longitudinally below the conveyor belt mechanism 26. The constitution of the paper feed cassette 28 is substantially the same as that of the paper feed cassette 28 of the image forming machine 300 shown in FIG. 7. The linear moving area 24*a* of the conveyor belt 24 is arranged on the right side in FIG. 9, the other linear moving area 24*b* is arranged on the left side, and the image forming units 4, 6, 8 and 10 are arranged on the right side of the linear moving area 24*a* of the conveyor belt 24. The drive roller 32 positioned at the top of the conveyor belt 24 is turned in the counterclockwise direction.

A paper feed conveyor passage 79 for carrying the paper P delivered upward from the paper feed cassette 28 upward toward the linear moving area 24*a* of the conveyor belt 24 is formed between the paper feed cassette 28 and the conveyor belt mechanism 26. The paper feed conveyor passage 79 is provided with the paper detection sensor S1. This paper detection sensor S1 has the same function as the paper detection sensor S1 of the image forming machine 100 shown in FIG. 1. The fixing unit 60 is arranged above the conveyor belt mechanism 26 in the upper end portion of the inside of the image forming machine body 2 like the image forming machines 100 and 200 shown in FIG. 1 and FIG. 6. The paper conveyor passage 62 for guiding the paper P which is carried by the conveyor belt mechanism 26 and to which the toner images have been transferred to the fixing unit 60 is formed between the conveyor belt mechanism 26 and the fixing unit 60 like the image forming machines 100 and 200 shown in FIG. 1 and FIG. 6. The paper conveyor passage 62, the linear moving area 24*a* of the conveyor belt 24 and the paper feed conveyor passage 79 are aligned with one another almost in the vertical direction. This constitution greatly contributes to the reduction of the size in the width direction of the image forming machine body 2 and can suppress the occurrence of a jam as there is almost no curve in the conveyor passages of the paper P. Since other constitution is substantially the same as that of the image forming machine 200 shown in FIG. 6, its description is omitted.

Since the conveyor belt mechanism 26 of the image forming machine 500 shown in FIG. 9 is arranged longitudinally so that the linear moving area 24*a* of the conveyor belt 24 extends almost in the vertical direction and the paper feed cassette 28 is arranged longitudinally below the conveyor belt mechanism 26, the size in the width direction of the image forming machine body 2 can be made smaller than those of the image forming machines 100, 200, 300 and 400 shown in FIG. 1, FIG. 6, FIG. 7 and FIG. 8, thereby making it possible to make the entire image forming machine body 2 more compact than those of the image forming machines 100, 200, 300 and 400. Accordingly, the image forming machine 500 of the present invention is particularly advantageous for use at an office in which the installation space in the lateral direction is limited.

Figure 10:
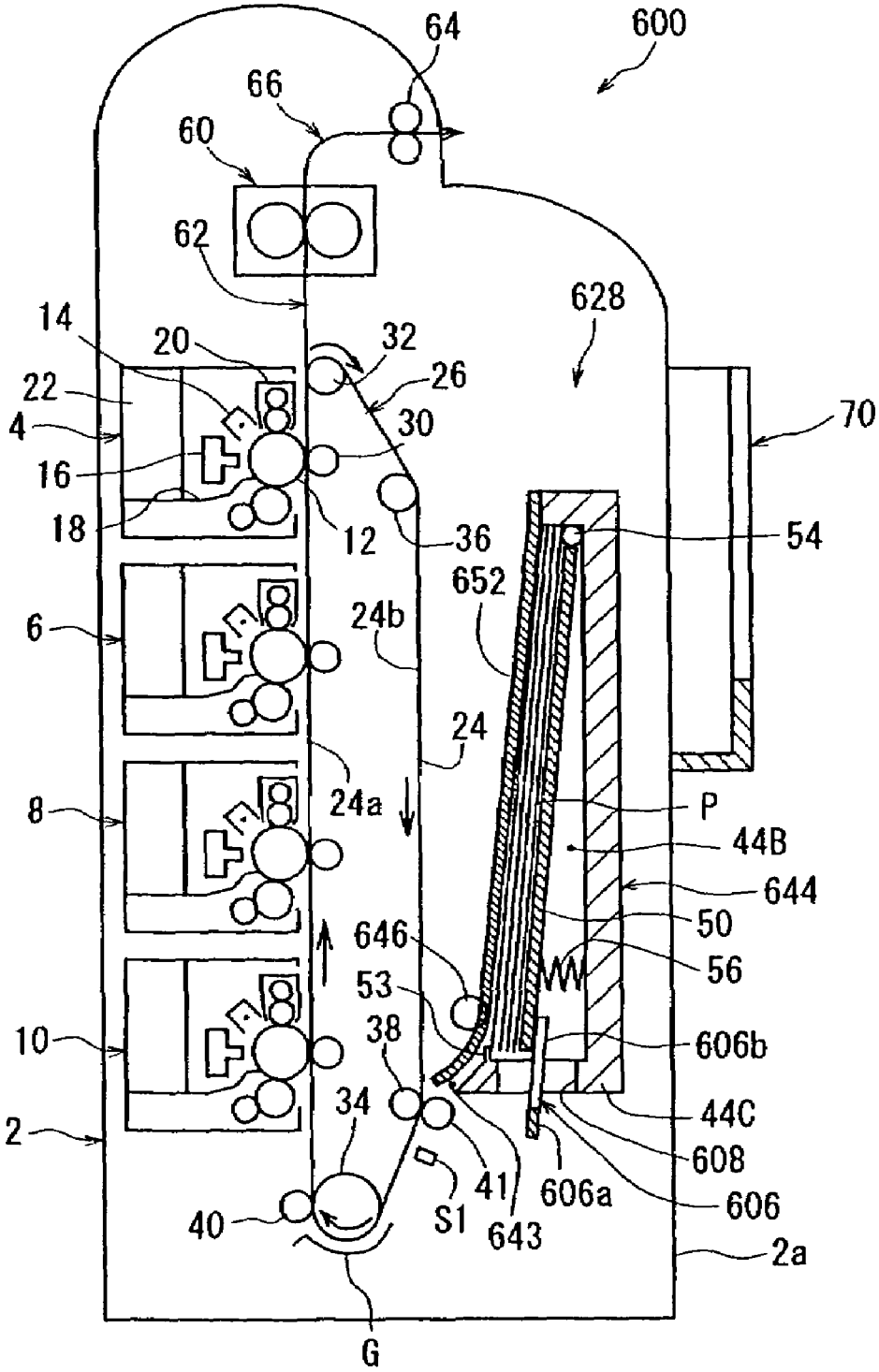
FIG. 10 is a schematic diagram showing a still further embodiment of a tandem type color image forming machine constituted according to the present invention.
Figure 11:
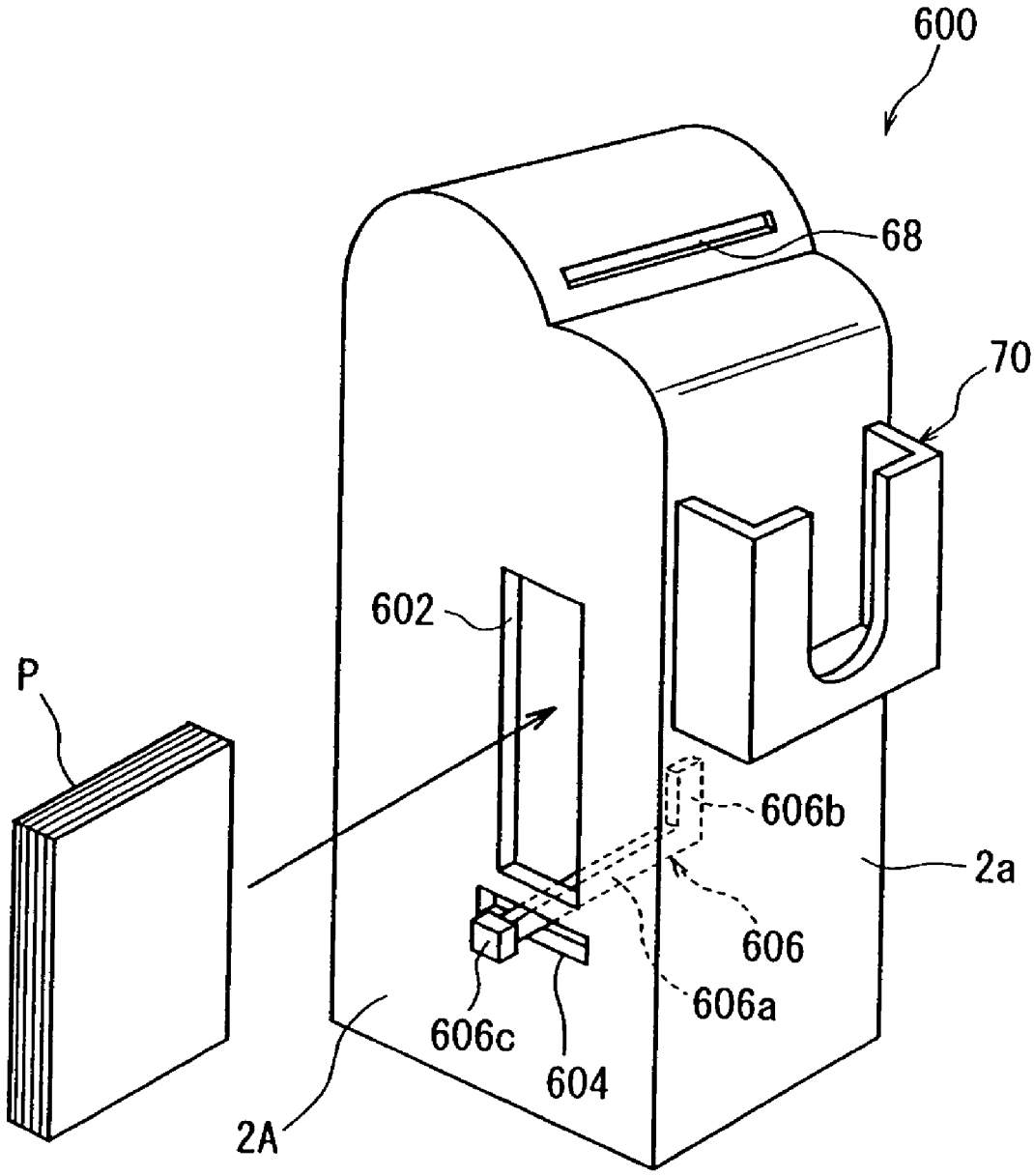
FIG. 11 is a perspective view schematically illustrating the image forming machine shown in FIG. 10 together with a bundle of paper sheets inserted into the paper feed cassette arranged in the image forming machine body from a paper feed opening formed in the image forming machine body.

FIG. 10 and FIG. 11 show a still further embodiment of the image forming machine of the present invention. In the image forming machine 600 shown in FIG. 10 and FIG. 11, a paper feed cassette 628 is arranged longitudinally in the image forming machine body 2 almost like the paper feed cassette 28 of the image forming machine 100 shown in FIG. 1. The paper feed cassette 628 comprises a box-like cassette 644 and a paper fall preventing plate 652 but does not have the cassette body 42 of the paper feed cassette 28. Although the cassette 644 is fixed in the image forming machine body 2 and has the same box-like shape as the cassette 44 of the paper feed cassette 28, the front wall 44A does not exist. This is because the paper P is supplied into the cassette 44 from an opening 602 in the front face 2A of the image forming machine body 2 as will be described hereinafter. In the cassette 644, the paper supporting plate 50 and the compression coil spring 56 are installed substantially in the same manner as in the paper feed cassette 28. The paper fall preventing plate 652 is fixed in the image forming machine body 2 to cover the cassette 644. Although a paper feed roller 646 has substantially the same constitution as the paper feed roller 46 of the paper feed cassette 28, its shaft 46A (see FIG. 5) is rotatably supported to the image forming machine body 2. The opening 602 for supplying paper into the paper feed cassette 628 from the front side of the image forming machine body 2 is formed in the front face 2A of the image forming machine body 2. The opening 602 is rectangular with the shorter side at the top. An opening 604 which extends horizontally in the width direction of the image forming machine body 2 is formed below the opening 602 in the front face 2A of the image forming machine body 2. The opening 604 is rectangular with the longer side at the top.

An operation arm 606 is fixed to the lower end portion of the paper supporting plate 50. The operation arm 606 has a horizontal portion 606*a* which extends horizontally in the front-and-rear direction of the image forming machine body 2, an upright portion 606*b* which extends upward from the rear end of the horizontal portion 606*a* at a right angle, and a knob 606*c* provided at the front end of the horizontal portion 606*a*. The horizontal portion 606*a* and the upright portion 606*b* of the operation arm 606 are formed from a metal plate integratedly. The upright portion 606*b* of the operation arm 606 is fixed to the right face in FIG. 10 of the lower end portion of the paper supporting plate 50, and the horizontal portion 606*a* extends to the front side of the image forming machine body 2 through the opening 604 of the image forming machine body 2. The knob 606*c* of the operation arm 606 is positioned on the front side of the image forming machine body 2. An opening 608 through which the upright portion 606*b* of the operation arm 606 extends is formed in the one side wall 44C of the cassette 644. The opening 608 is rectangular and prolonged sideways to allow the movement in the right-and-left direction in FIG. 10 of the upright portion 606*b*. An opening 643 for paper feeding is formed between the left end in FIG. 10 of the one side wall 44C of the cassette 644 and the lower end portion in FIG. 10 of the paper fall preventing plate 652.

Since the other constitution of the image forming machine 600 shown in FIG. 10 is substantially the same as the image forming machine 100 shown in FIG. 1, its description is omitted. As obvious from the above description, the paper feed cassette 628 of the image forming machine 600 cannot be drawn from the image forming machine body 2. To supply the paper P into the paper feed cassette 628, the knob 606*c* of the operation arm 605 is used to move the operation arm 606 to the right in FIG. 10 along the opening 604 manually. The paper supporting plate 50 connected to the operation arm 606 is turned round the shaft 54 in the counterclockwise direction in FIG. 10 in defiance of the spring force of the compression coil spring 56. As a result, a space (not shown) is formed between the paper fall preventing plate 652 and the paper supporting plate 50 in the cassette 644, whereby a bundle of paper sheets P can be inserted into the space in the cassette 644 from the opening 602 formed in the front face 2A of the image forming machine body 2. It is preferred that a side wall which is not shown in the figure should be formed on the front side in FIG. 10 of the paper fall preventing plate 652 to prevent the bundle of paper sheets P stored in the cassette 644 from shifting to the front side.

When a finger is released from the knob 606*c* of the operation arm 606 after the bundle of paper sheets P is stored in the cassette 644, the paper supporting plate 50 is turned round the shaft 54 in the clockwise direction in FIG. 10 by the spring force of the compression coil spring 56. Since the bundle of paper sheets P stored in the cassette 644 is urged toward the paper fall preventing plate 652, the lower end of the paper sheet P positioned at the left end in FIG. 10 is brought into pressure contact with the paper feed roller 646 to enable paper feeding.

Since the image forming machine 600 shown in FIG. 10 and FIG. 11 has substantially the same constitution as the image forming machine 100 shown in FIG. 1 except that the paper feed cassette 628 is fixed in the image forming machine body 2, substantially the same effect as that of the image forming machine 100 can be obtained.

Figure 12:
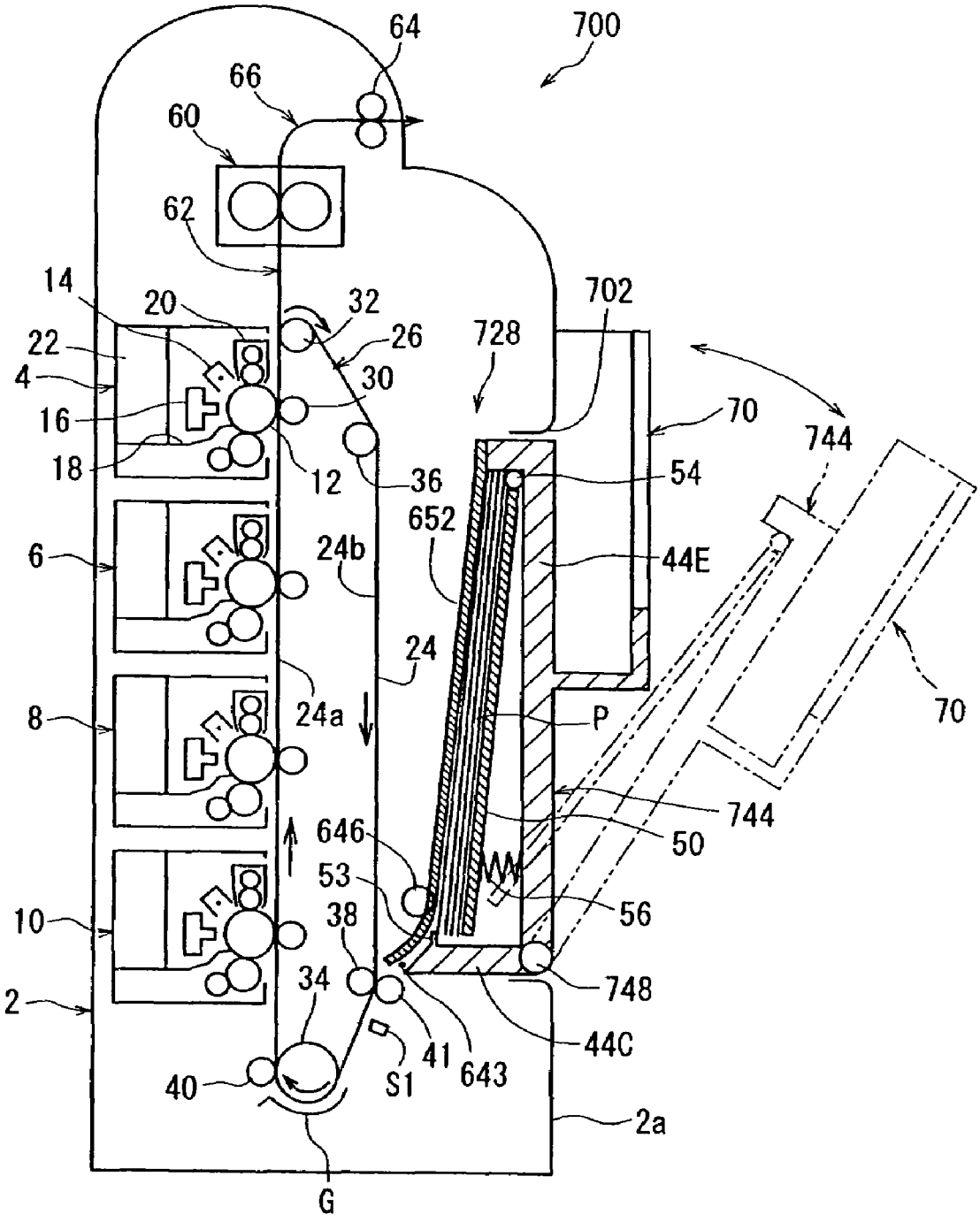
FIG. 12 is a schematic diagram showing a still further embodiment of a tandem type color image forming machine constituted according to the present invention.
Figure 13:
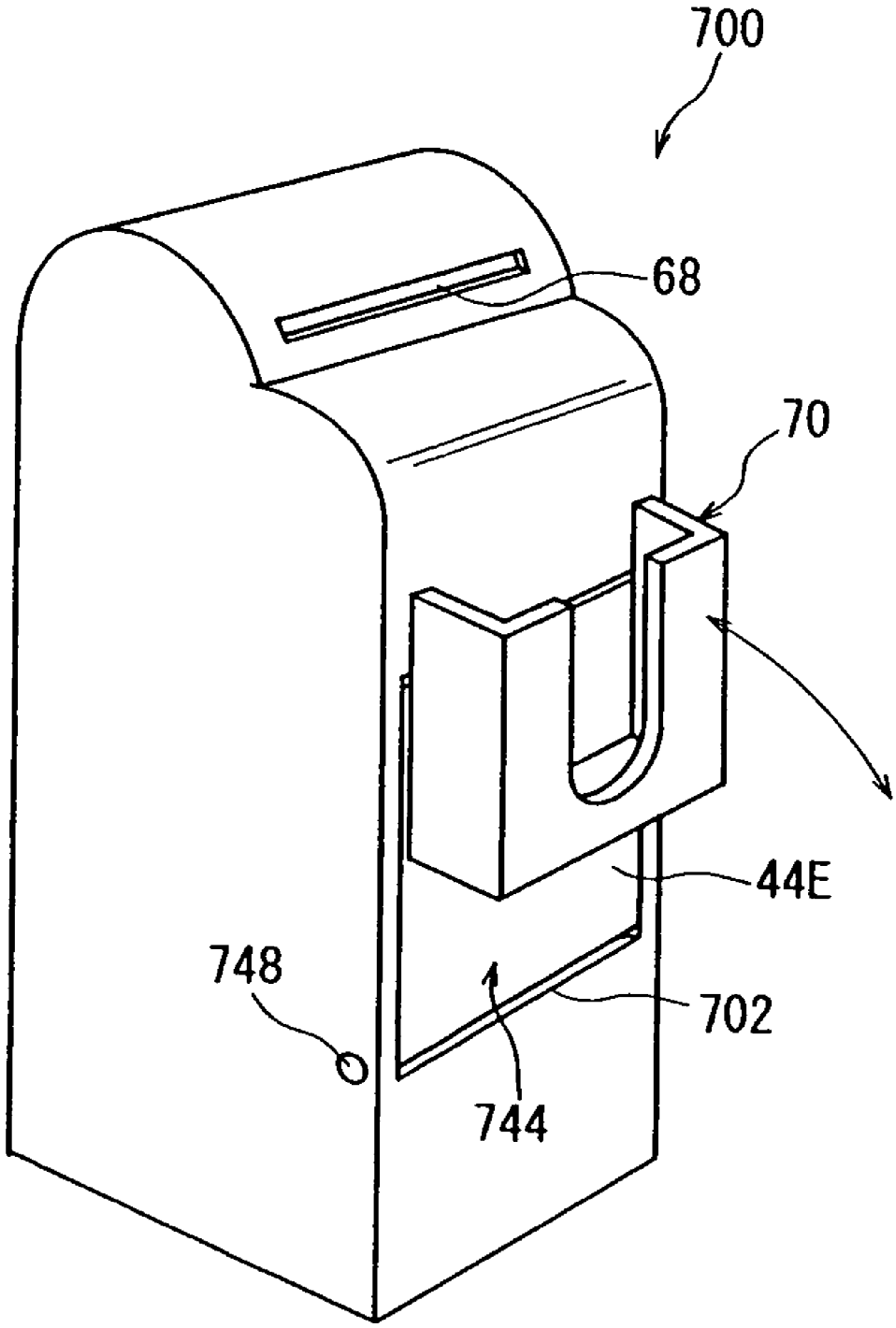
FIG. 13 is a perspective view schematically illustrating the image forming machine shown in FIG. 12.

FIG. 12 and FIG. 13 show a still further embodiment of the image forming machine of the present invention. In the image forming machine 700 shown in FIG. 12 and FIG. 13, a paper feed cassette 728 is arranged longitudinally in the image forming machine body 2 substantially in the same manner as the paper feed cassette 28 of the image forming machine 100 shown in FIG. 1. The paper feed cassette 728 comprises a box-like cassette 744 and the paper fall preventing plate 652 but not the cassette body 42 of the paper feed cassette 28. The cassette 744 has substantially the same box-like shape as the cassette 44 of the paper feed cassette 28 and is rotatably supported in the image forming machine body 2 by a pair of shafts 748. The pair of shafts 748 are arranged likewise in the cassette 744 substantially at the same position as in the cassette 44 of the paper feed cassette 28. The cassette 744 can turn between an acting position where it is substantially stored in the image forming machine body 2 (position shown by a solid line in FIG. 12 and position shown in FIG. 13) and a non-acting position where it is turned round the pair of shafts 748 in the clockwise direction in FIG. 12 from the acting position (position shown in a two-dotted chain line in FIG. 12). The right end face in FIG. 12 of the bottom wall 44E of the cassette 744 becomes substantially flush with the one side face 2*a* of the image forming machine body 2 when the cassette 744 is located at the acting position. An opening 702 is formed in the one side face 2*a* of the image forming machine body 2 to allow the above turning of the cassette 744. A lock mechanism which can be unlocked freely and may have known constitution is interposed between the cassette 744 and the image forming machine body 2.

In the cassette 744, there are installed the paper supporting plate 50 and the compression coil spring 56 substantially in the same manner as in the paper feed cassette 28. The paper fall preventing plate 652 and the paper feed roller 646 have substantially the same constitution as those of the image forming machine 600 and are disposed in the image forming machine body 2 substantially in the same manner. The pocket 70 is integrated with the right end face in FIG. 12 of the bottom wall 44E of the cassette 744.

Since the other constitution of the image forming machine 700 shown in FIG. 12 and FIG. 13 is substantially the same as that of the image forming machine 100 shown in FIG. 1, its description is omitted. As obvious from the above description, the paper feed cassette 728 of the image forming machine 700 cannot be drawn from the image forming machine body 2 but can be turned. To supply the paper P into the paper feed cassette 728, the cassette 744 is turned round the pair of shafts 748 from the acting position to the non-acting position. Since the top side of the paper supporting plate 50 is made open outside the one side face 2*a* of the image forming machine body 2 when the cassette 744 is located at the non-acting position, a bundle of paper sheets P can be supplied onto the paper supporting plate 50 from above. The turning angle of the cassette 744 is preferably set to the minimum angle at which the paper P can be supplied onto the paper supporting plate 50.

After the bundle of paper sheets P is supplied onto the paper supporting plate 50 from above, the cassette 744 is turned from the non-acting position to the acting position. As a result, the paper P stored in the cassette 744 can be fed. When the cassette 744 is located at the acting position, the pocket 70 extends along the one side face 2*a* of the image forming machine body 2 in the vertical direction and can store the paper P discharged from the pair of discharge rollers 64.

The image forming machine 700 shown in FIG. 12 and FIG. 13 has substantially the same constitution as the image forming machine 100 shown in FIG. 1 except that the paper feed cassette 728 is rotatably arranged in the image forming machine body 2 and that the pocket 70 is integrated with the cassette 744. In the image forming machine 700, when the cassette 744 is turned to the non-acting position, it projects outward from the one side face 2*a* of the image forming machine body 2, thereby requiring a space in the width direction. However, by minimizing the turning angle of the cassette 744, the size in the width direction of the image forming machine 700 can be made smaller than that of the prior art. When the cassette 744 is located at the acting position, the size in the width direction of the image forming machine body 2 can be made smaller than that of the prior art substantially like the image forming machines 100, 200, 300, 500 and 600.

In the above image forming machines 100, 200, 300, 500, 600 and 700, as the fixing unit 60 is arranged in the upper end portion of the inside of the image forming machine body 2, its heat is easily removed to the outside of the image forming machine body 2 and a rise in the inside temperature of the image forming machine body 2 can be suppressed. In the above image forming machines 100, 200, 300, 400 and 500, as the paper feed cassette 28 can be drawn forward from the image forming machine body 2, the supply of the paper P can be performed on the front side of the image forming machine body 2. In the image forming machine 600, the paper feed cassette 628 is fixed in the image forming machine body 2 but the paper 2 can be supplied from the front side of the image forming machine body 2, thereby making it possible to reduce the spaces on both sides in the width direction of the image forming machine body 2. In the above image forming machines 100, 200, 300, 400 and 500, the paper feed cassettes 28 for storing small-sized to large-sized paper sheets can be drawn from the image forming machine body 2 while the size in the width direction of the image forming machine body 2 can be minimized. Therefore, they are of great practical value.

In general, the term "paper feed cassette" in the image forming machine means a paper feed cassette comprising a box-like cassette which can be drawn from the image forming machine body. However, in this text, the term "paper feed cassette" means not only this known paper feed cassette but also the paper feed cassette 628 of the image forming machine 600 comprising the cassette 644 which is fixed in the image forming machine body 2 or the paper feed cassette 728 of the image forming machine 700 comprising the cassette 744 which is rotatably arranged in the image forming machine body 2.

What is claimed is:

1. A tandem type color image forming machine comprising a plurality of image forming units for forming images with different color toners, a belt mechanism comprising an endless belt including a linear moving area, an image forming machine body and a paper feed cassette for storing paper in its image forming machine body, the image forming units being arranged along the linear moving area of the belt with a space therebetween, wherein the belt mechanism is arranged longitudinally so that the linear moving area of the belt extends almost in the vertical direction, the paper feed cassette is arranged longitudinally in the lateral direction of the belt mechanism, or below the belt mechanism, the belt is a conveyor belt including the linear moving area for carrying paper, the belt mechanism is a conveyor belt mechanism comprising the conveyor belt, a pair of discharge rollers are arranged in the upper end portion of the inside of the image forming machine body, a paper discharge passage is formed between the fixing unit and the pair of discharge rollers in such a manner that it extends upward from the fixing unit, curves, and goes toward the pair of discharge rollers almost in the lateral direction, and a pocket for receiving and storing paper discharged from the pair of discharge rollers and going downward by its own weight is formed on one side face of the image forming machine body in the downstream direction of the pair of discharge rollers in such a manner that it extends along the one side face in the vertical direction.

2. The tandem type color image forming machine according to claim 1, wherein the conveyor belt of the conveyor belt mechanism is arranged around a plurality of rollers, a charging conveyor roller is pressed against one of the rollers arranged in the lower end area of the conveyor belt on the upstream side of the linear moving area of the conveyor belt through the conveyor belt, and the position of the paper feed cassette relative to the conveyor belt mechanism is determined such that paper stored in the paper feed cassette is delivered downward toward a nip portion between the charging conveyor roller and the conveyor belt.

3. The tandem type color image forming machine according to claim 1, wherein a paper inversion conveyor passage for inverting paper fed downward from the paper feed cassette and carrying it upward toward the linear moving area of the conveyor belt is formed between the paper feed cassette and the conveyor belt mechanism.

4. The tandem type color image forming machine according to claim 1, wherein a fixing unit is arranged above the conveyor belt mechanism in the upper end portion of the inside of the image forming machine body, a paper conveyor passage for guiding paper which is carried by the conveyor belt mechanism and to which toner images have been transferred to the fixing unit is formed between the conveyor belt mechanism and the fixing unit, and the paper conveyor passage and the linear moving area of the conveyor belt are aligned with each other almost in the vertical direction.

* * * * *